US012352122B2

(12) United States Patent
Thomas et al.

(10) Patent No.: US 12,352,122 B2
(45) Date of Patent: Jul. 8, 2025

(54) DIRECTIONAL CORE DRILLING SYSTEM

(71) Applicant: International Directional Services LLC, Chandler, AZ (US)

(72) Inventors: Zach Thomas, Houston, TX (US); Kai Penzhorn, Houston, TX (US); Brian Smith, The Woodlands, TX (US)

(73) Assignee: INTERNATIONAL DIRECTIONAL SERVICES LLC, Chandler, AZ (US)

( * ) Notice: Subject to any disclaimer, the term of this patent is extended or adjusted under 35 U.S.C. 154(b) by 0 days.

(21) Appl. No.: 18/332,077

(22) Filed: Jun. 9, 2023

(65) Prior Publication Data

US 2023/0313626 A1 Oct. 5, 2023

Related U.S. Application Data

(63) Continuation-in-part of application No. 17/733,669, filed on Apr. 29, 2022.

(60) Provisional application No. 63/242,578, filed on Sep. 10, 2021.

(51) Int. Cl.
*E21B 25/00* (2006.01)
*E21B 7/04* (2006.01)

(52) U.S. Cl.
CPC ..... *E21B 25/00* (2013.01); *E21B 7/04* (2013.01)

(58) Field of Classification Search
CPC ..... E21B 4/02; E21B 25/02; E21B 7/062
See application file for complete search history.

(56) References Cited

U.S. PATENT DOCUMENTS 2,014,806 A * 9/1935 Howard ..... E21B 25/12 175/333
3,485,310 A * 12/1969 Milosevich ..... E21B 25/02 175/246
5,029,653 A * 7/1991 Jurgens ..... E21B 7/061 175/58
5,115,872 A 5/1992 Brunet et al.
6,148,933 A 11/2000 Hay et al.
6,516,900 B1 2/2003 Tokle
(Continued)

FOREIGN PATENT DOCUMENTS

WO 2019068145 A1 4/2019

OTHER PUBLICATIONS

International Preliminary Report on Patentability for International Application No. PCT/US2022/027068 mailed Mar. 21, 2024.
(Continued)

*Primary Examiner* — Robert E Fuller
(74) *Attorney, Agent, or Firm* — Carlson, Gaskey & Olds, P.C.

(57) ABSTRACT

A directional core drilling includes an outer barrel assembly with a guide sleeve that defines a tilt angle for orientating a drill bit within a hole and a drive barrel rotationally supported within the outer barrel assembly. An inner drive assembly is receivable within the outer barrel assembly and includes a torque latch assembly and an anti-rotation bearing assembly. The torque latch assembly includes latch arms configured to releasably couple a rotational drive input to the drive barrel. A core barrel is coupled to the anti-rotation bearing assembly and is rotationally fixed relative to the drive barrel.

25 Claims, 30 Drawing Sheets

(56) References Cited

U.S. PATENT DOCUMENTS

| | | | | |
|---|---|---|---|---|
| 6,644,424 | B1 * | 11/2003 | Fanuel | E21B 25/02 175/252 |
| 8,561,720 | B2 | 10/2013 | Edbury et al. | |
| 8,869,916 | B2 | 10/2014 | Clausen et al. | |
| 10,301,937 | B2 | 5/2019 | Buchanan et al. | |

OTHER PUBLICATIONS

International Search Report and Written Opinion for International Application No. PCT/US2022/027068 mailed Jul. 12, 2022.

* cited by examiner

DIRECTIONAL CORE DRILLING SYSTEM

CROSS REFERENCE TO RELATED APPLICATION

This application is a continuation-in-part of U.S. patent application Ser. No. 17/733,669 filed on Apr. 29, 2022, which claims priority to U.S. Provisional Application No. 63/242,578 filed on Sep. 10, 2021.

TECHNICAL FIELD

The present disclosure relates to a directional drilling system for obtaining core samples.

BACKGROUND

Directional drilling is a process of steering a drill bit through the earth in various directions and angles relative to an entrance hole. Directional drilling is performed utilizing a directional drilling system that includes an outer barrel on which an axial force is applied, an inner assembly that includes a motor for generating rotation of a bit. The motor is located downhole and is powered by pressurized flow communicated through the outer pipe. In some applications an inner barrel assembly is included for capturing a core sample, the inner barrel assembly is disposed at an end of the drilling system and remains rotationally fixed relative to the rotating drill bit. The inner barrel is then retrieved once a core of a desired length is obtained. The directional bit may be steered to direct the drilling and obtaining of samples from specific locations.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A directional core drilling assembly according to an example disclosed embodiment includes, among other possible things, an outer barrel assembly including a guide sleeve that defines a tilt angle of a drill bit within a hole and a drive barrel rotationally supported within the outer barrel assembly. The drill bit is attached to a downhole end of the drive barrel and an inner drive assembly is receivable within the outer barrel assembly. The inner drive assembly includes a torque latch assembly and an anti-rotation bearing assembly. The torque latch assembly includes latch arms configured to releasably couple a rotational drive input to the drive barrel. A core barrel is coupled to the anti-rotation bearing assembly and movable into a position within the drive barrel such that the core barrel is rotationally fixed relative to the drive barrel.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
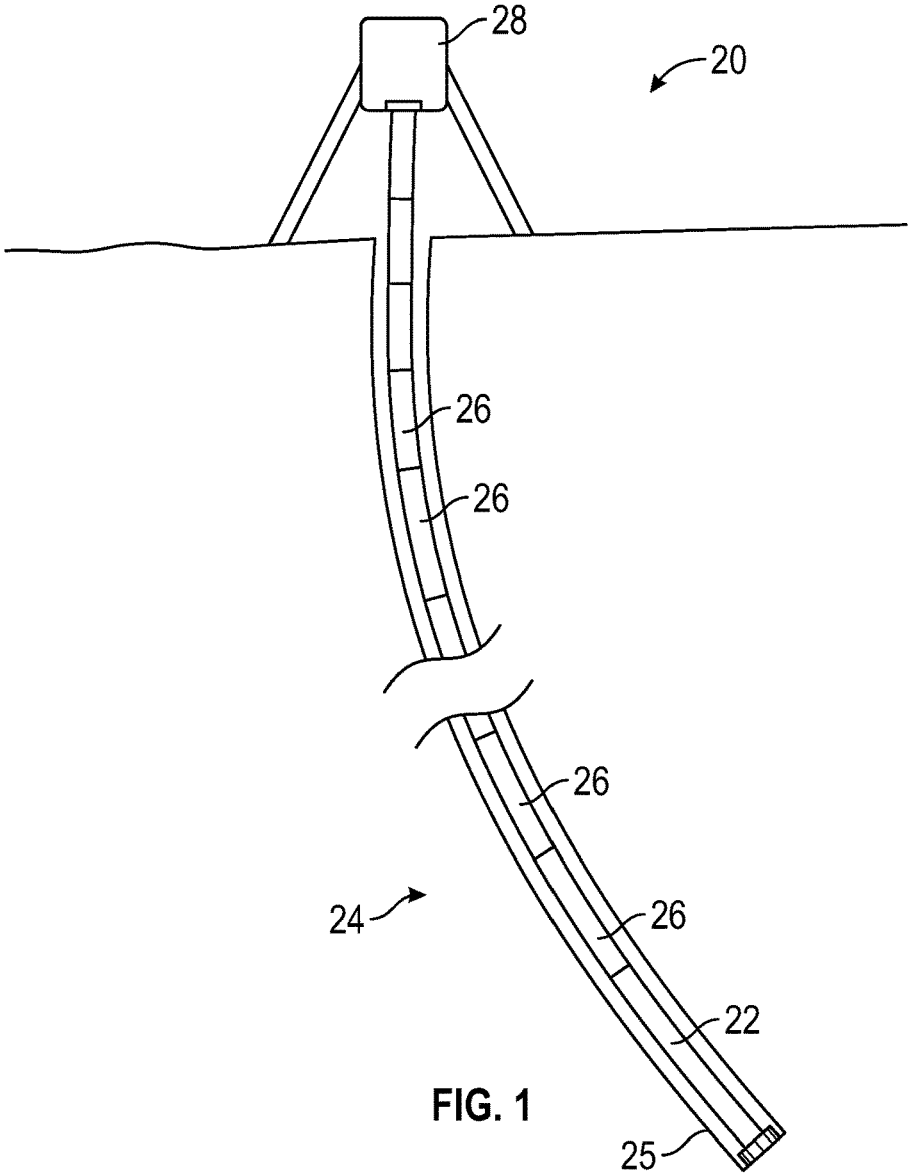
FIG. 1 is a schematic view of an example directional core sample drilling system.

Referring to FIG. 1 an example system for obtaining core samples is schematically shown and indicated at 20. The system 20 includes a directional core drilling (DCD) assembly 22 that is disposed at the end of drill string 24 supported by a drilling rig 28 on the surface. The drill string 24 includes a plurality of drill pipes 26 coupled together to extend the DCD assembly 22 into a borehole 25. The DCD assembly 22 includes features for steering the drill string 24 and to bore and retrieve a core sample.

Figure 2:
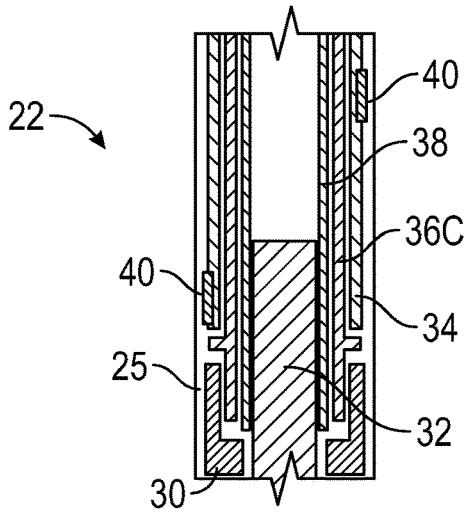
FIG. 2 is a schematic view of a portion of an example directional core drilling system embodiment.

Referring to FIG. 2 with continued reference to FIG. 1, the DCD assembly 22 includes a drill bit 30 that cuts into the earth, stone, and rock to form the borehole 25. A bit adaptor 36C of a drive barrel assembly 36 rotating within a non-rotating outer barrel assembly 34 drives rotation of the drill bit 30. A core barrel 38 is disposed within the drive barrel assembly 36 and does not rotate. A core sample 32 is received and held within the core barrel 38 as the drill bit 30 advances into the earth. Once the drill bit 30 has advanced a sufficient distance downhole to obtain a core sample of a desired length, the core 32 is pulled to the surface through the drill string 24. The outer barrel 34 includes steering pads 40 that orientate the DCD assembly 22 within the borehole 25 to guide the formation of the borehole 25.

Figure 3:
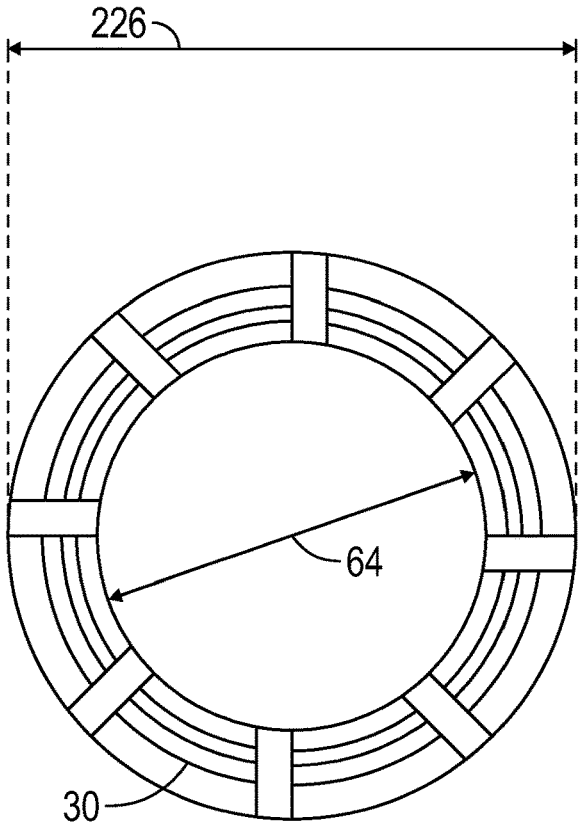
FIG. 3 is a schematic view of an end of the directional core sample drilling system.
Figure 4:
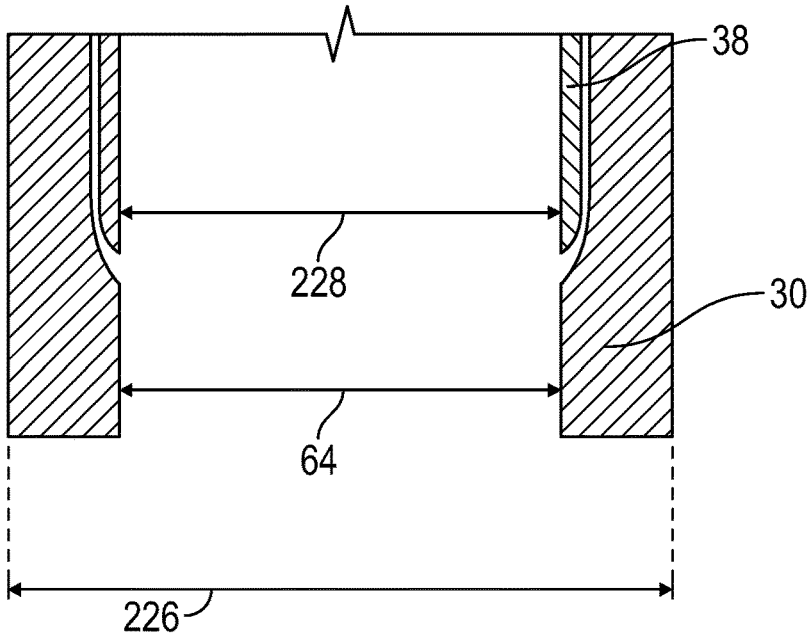
FIG. 4 is a simplified cross-section of an end of the example core sample drilling system.

Referring to FIGS. 3 and 4 with continued reference to FIGS. 1 and 2, the disclosed DCD assembly 22 provides for an increased core diameter as compared to previous core drilling systems. The drill bit 30 includes an outer drill bit diameter 226 that defines a diameter of the borehole 25 generated during operation. An inner diameter 64 of the drill bit 30 corresponds to a diameter of a core sample captured during operation. An inner diameter 228 of the core barrel 38 is indicative of the capacity of the DCD assembly 22 to obtain larger diameter core samples relative to the hole's diameter generated by the drill bit 30.

The features and configuration of the DCD assembly 22 as will be disclosed and described by way of example provide for the increased size of a core sample. The increase in size of the core sample is reflected in a relationship between the inner diameter 64 and the overall outer drill bit diameter 226. In one example disclosed embodiment, the inner diameter 64 is between 58% and 70% as large as the drill bit diameter 226. In another disclosed example embodiment, the inner diameter 64 is between 60% and 68% as large as the drill bit diameter 226. In another disclosed example embodiment, the inner diameter 64 is about 62% of the drill bit diameter 226. In still another example embodiment, the inner diameter 64 is about 64% of the drill bit diameter 226. In another example embodiment, the inner diameter 64 is about 67% of the drill bit diameter 226.

Figure 5:
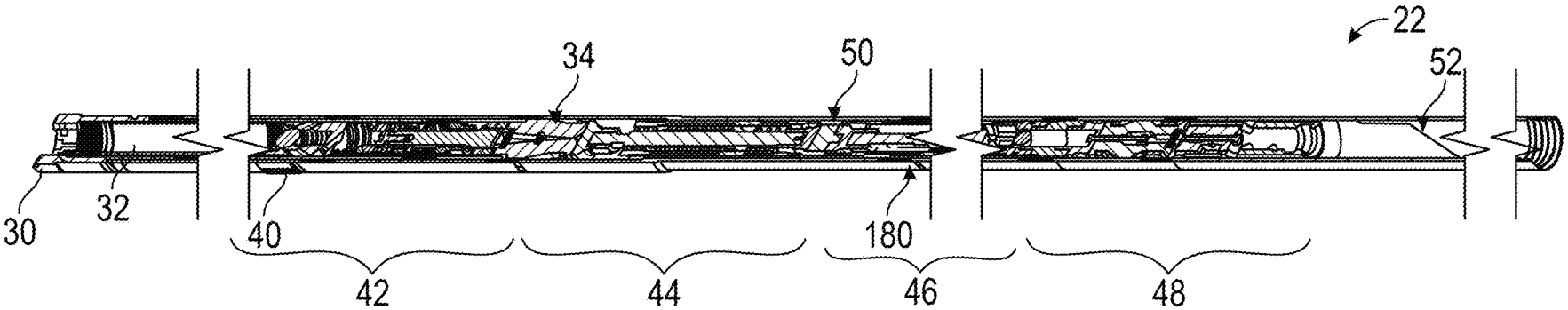
FIG. 5 is a cross-section of an example directional core drilling system.
Figure 6:
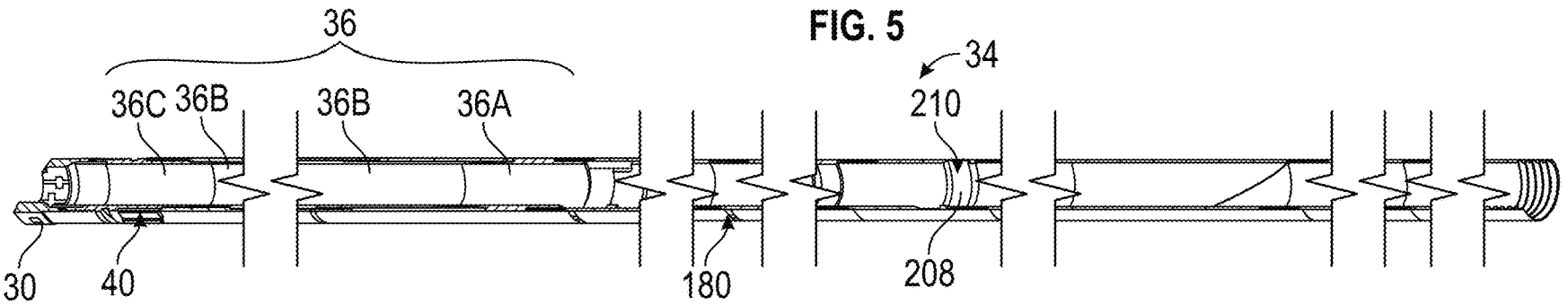
FIG. 6 is a cross-section of an example outer barrel assembly embodiment.
Figure 7:
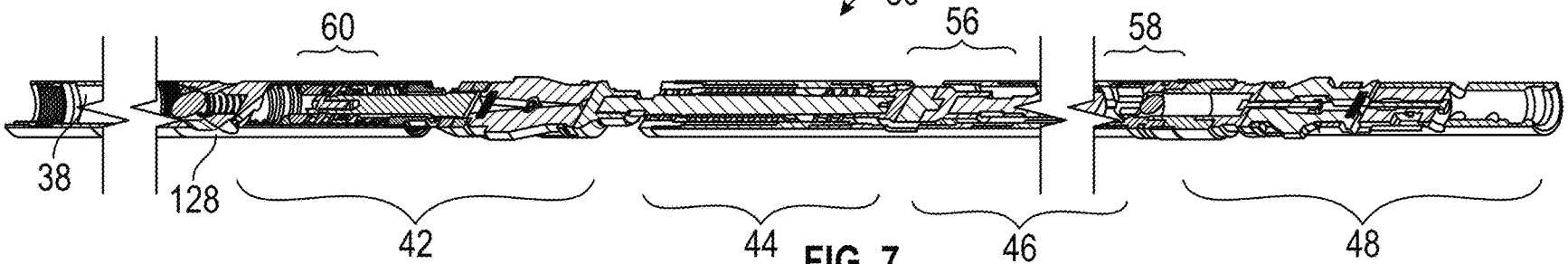
FIG. 7 is a cross-section of an example inner drive assembly embodiment.

Referring to FIGS. 5, 6 and 7 with continued reference to FIGS. 1 and 2, the DCD assembly 22 is shown in sectional views to show separate assemblies that provide for the rotation of the drill bit 30, steering of the DCD assembly 22 and capture of the core sample 32. The DCD assembly 22 includes an outer barrel assembly 34 and an inner drive assembly 50. The inner drive assembly 50 is inserted through the drill string 24 to the outer barrel assembly 34. The outer barrel assembly 34 remains downhole and coupled to the drill string 24. A drive barrel assembly 36 is supported within the outer barrel assembly 34 and is coupled to the drill bit 30. The drive barrel assembly 36 includes a torque coupling 36A, a drive barrel 36B and a bit adaptor 36C. The torque coupling 36A is coupled to a downhole motor assembly commonly referred to as a mud motor 46 through a thrust bearing assembly 44 and a drive coupling assembly 42.

A latch assembly 48 secures the inner drive assembly 50 within the outer barrel assembly 34 in a desired position that aligns drive features of the drive coupling assembly 42. The latch assembly 48 engages an inner circumferential groove 208 of the outer barrel assembly 34 to transfer axial forces. The latch assembly 48 further provides for retrieval of the inner drive assembly 50 and a core sample.

The inner drive assembly 50 further includes the core barrel 38 that is disposed within the drive barrel assembly 36. The core barrel 38 is isolated from rotation of the drive barrel assembly 36 by a double-acting anti-rotation thrust bearing assembly 60 (FIG. 7).

Figure 8:
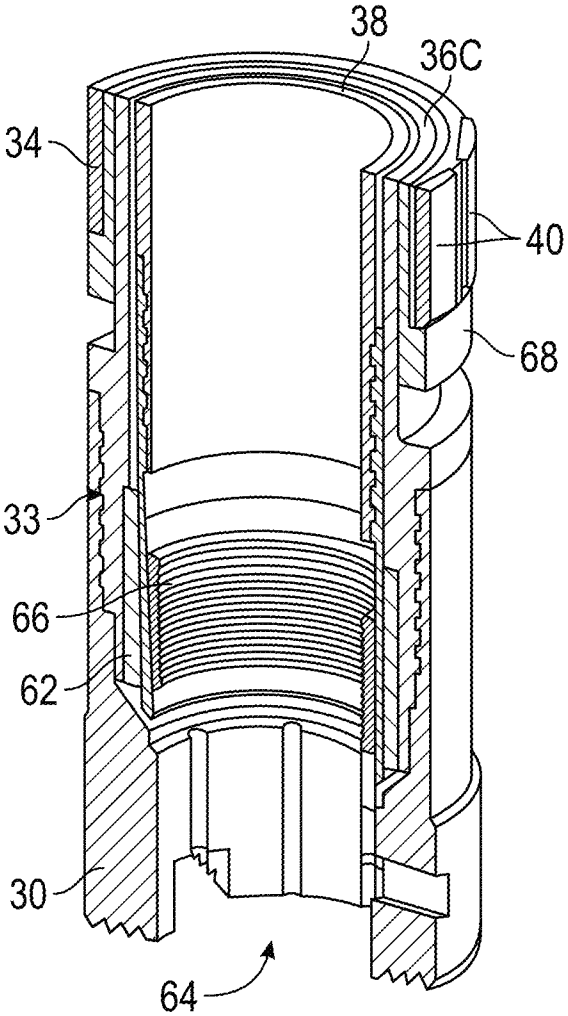
FIG. 8 is a cross-section of a portion of an example drill bit and a portion of an example core barrel embodiment.

Referring to FIG. 8 with continued reference to FIGS. 5,6 and 7, the downhole end of the DCD assembly 22 is shown in a sectional view to illustrate the relative orientation of the outer barrel assembly 34, the bit adaptor 36C of the drive barrel assembly 36 and the core barrel 38. The core barrel 38 and the outer barrel assembly 34 do not rotate. The latch assembly 48 provides for application of an axial force to the outer barrel assembly 34 through the drill string 24 in a known matter. The core barrel 38 is coupled to the inner drive assembly 50 in a manner that isolates it from rotation. The drive barrel assembly 36 rotates between the core barrel 38 and the outer barrel assembly 34. The drill bit 30 is coupled to the bit adaptor 36C through a threaded connection 33. It should be appreciated that the illustrated drill bit 30 is disclosed by way of example and that other drill bit configurations may be utilized and are within the contemplation and scope of this disclosure.

A centralizing bearing 62 is disposed between the rotating bit adaptor 36C of the drive barrel assembly 36 and a core lifter case 66 that is secured to an end of the core barrel 38. The centralizing bearing 62 isolates the core barrel 38 from the rotation of the drive barrel assembly 36. The centralizing bearing 62 is formed from a self-lubricating material to provide for a desired low friction surface to reduce and/or substantially eliminate transmission or rotational forces into the core barrel 38.

The core lifter 66 comprises a plurality of back angled grooves. The back angled grooves provide low resistance to a core sample entering the inner area of the core barrel 38 as the drill bit 30 advances through the earth. However, the grooves will dig into the core sample and generate substantial forces to resist a core sample being pulled back out the end of the DCD assembly 22.

The drill bit 30 includes the inner diameter 64 that provides for the size and diameter of a desired core sample. The inner diameter 64 corresponds with the inner diameter 228 (FIGS. 3 and 4) of the core barrel 38 and the core lifter 66. The inner diameter 64 may be of a smaller diameter than the inner diameter 228 the core barrel 38, but not larger, to provide the core sample with defined path into the core barrel 38. However, the inner diameter 64 may not be so small as to prevent a core sample from being captured and held within the core barrel 38 by the grooves of the core lifter 66.

Figure 9:
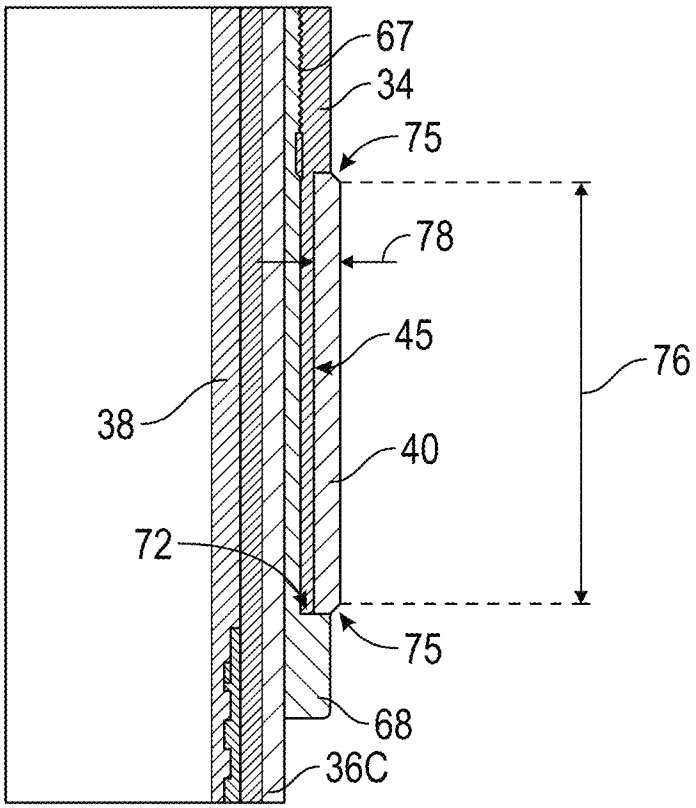
FIG. 9 is a cross-section of a portion of an example steering pad embodiment.

Referring to FIG. 9, with continued reference to FIG. 8, a radial bearing 68 is coupled to the end of the outer barrel assembly 34 and secures a group of steering pads 40 in place. FIG. 9 shows one of a lower set of steering pads 40. A second, upper set of steering pads 40 are secured to the outer barrel assembly 34 at a defined axial distance. The steering pads 40 engages with inner surfaces of the borehole 25 to define an orientation of the DCD assembly 22 that is offset from an axial center of the borehole 25. An offset between the upper and lower sets of steering pads 40 provides for generation of the borehole 25 at a desired angle that is different than straight. The desired offset is obtained by the number, size, and relative locations of the steering pads 40 along the outer surface of the outer barrel assembly 34.

The pads 40 are held in place within slots 45 formed on the outer surface of the outer barrel assembly 34 and by the radial bearing 68. A chamfer 75 is provided at the top and bottom of each steering pad 40 to aid movement through the borehole 25. The radial bearing 68 is coupled to the outer barrel assembly 34 through a threaded connection 67. In this disclosed embodiment, the threaded connection 67 includes threads that secure the radial bearing 68 with threads configured for securement in a direction opposite the rotational direction of the drill bit 30.

Figure 10:
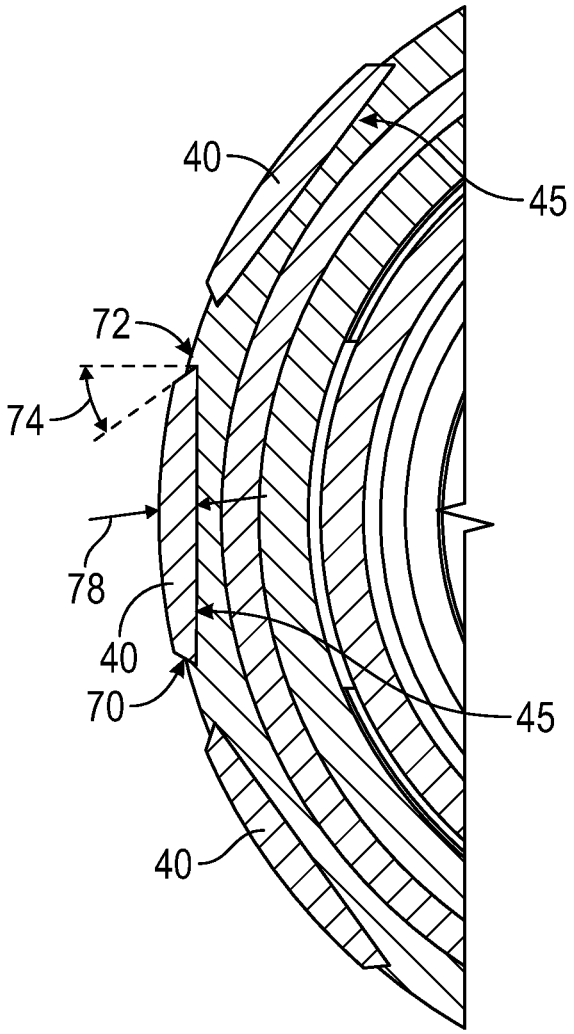
FIG. 10 is a schematic view of a portion of the example steering pad embodiment.
Figure 11:
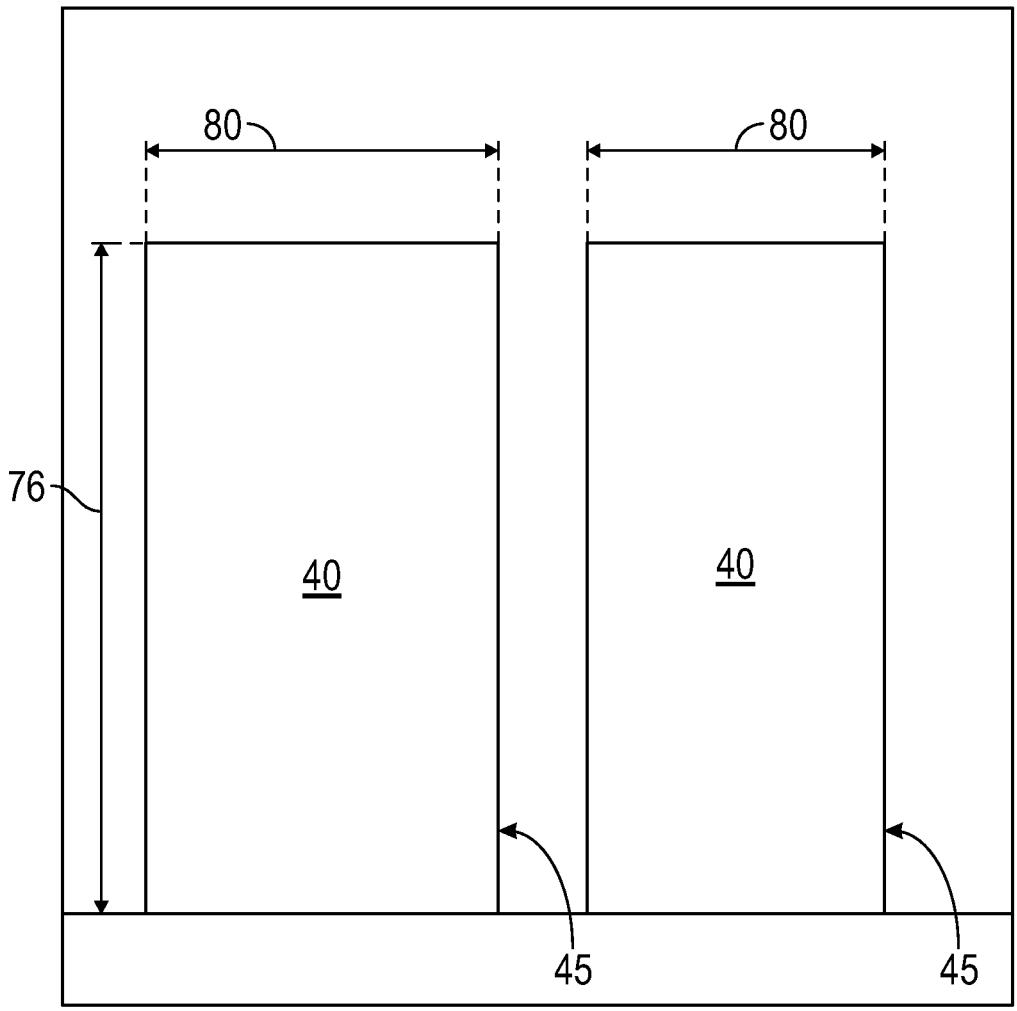
FIG. 11 is a side view of a portion of the example outer barrel assembly including example steering pads.

Referring to FIGS. 10, 11, with continued reference to FIG. 9, the angle that the DCD assembly 22 forms the borehole 25 is determined by the configuration of the steering pads 40. The configuration of the steering pads 40 include a size of each steering pad 40. Each steering pad 40 include a thickness 78, an axial height 76 and a width 80. Each of the thickness 78, height 76 and width 80 may be modified to generate the desired angle and thereby the direction of the borehole 25.

The pads 40 are held within the corresponding slots 45 by sides 70, 72 that each have a back angle 74. The back angle 74 is provided to hold the pads 40 in the slots 45, in combination with the threaded-on radial bearing 68 shown in FIG. 9.

The example pad 40 is shown by way of example and other sets of pads are located at different axial and radial locations. Moreover, pads 40 disposed at other locations, are secured within slots configured similar to those slots 45 shown in FIG. 9. The pads 40 would be secured at a top or bottom location at another joint and radially within back angled surfaces on sides of a corresponding slot.

Figure 12:
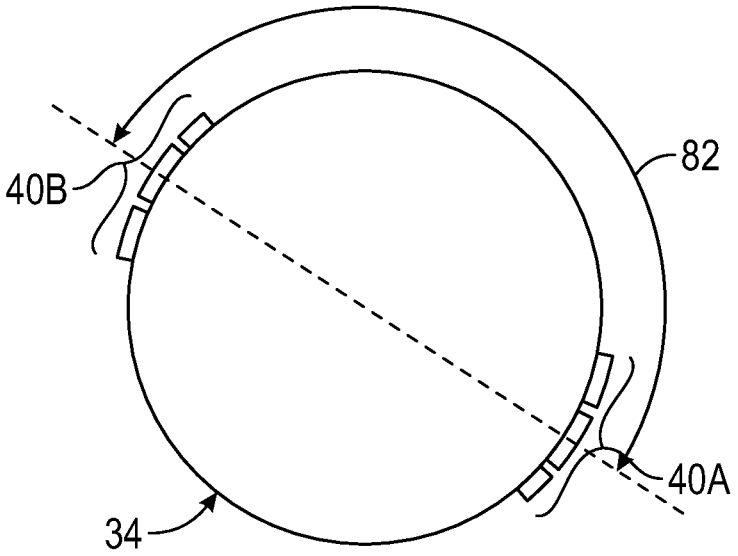
FIG. 12 is a schematic view of the example outer barrel assembly with circumferentially spaced apart steering pad groups.
Figure 13:
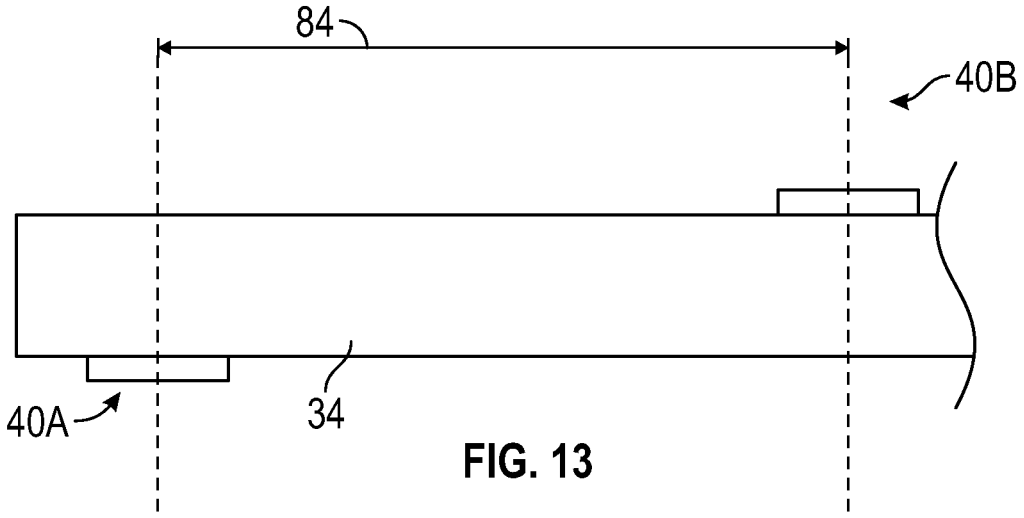
FIG. 13 is a schematic view of the example directional core drilling system with axially spaced apart steering pad groups.

Referring to FIGS. 12 and 13 with continued reference to FIGS. 9-11, the number of steering pads 40 may also be utilized to provide the desired angle and thereby direction of the DCD assembly 22. In one disclosed example, two groups of steering pads 40A and 40B are disclosed with each group including three steering pads 40. The two groups of steering pads 40A and 40B are spaced a circumferential distance 82 apart (FIG. 12) and an axial distance 84 part (FIG. 13). The distances 82 and 84 combine to provide a desired orientation of the DCD assembly 22 within the borehole 25. In this disclosed embodiment the two groups of steering pads 40A and 40B are spaced 180 degrees apart. The turning radius provided by the DCD assembly 22 is provided by the pad height and the orientation of the turn relates to the position in which the non-rotating outer barrel assembly is held stationary within the borehole 25 by the drilling rig 28 at the surface.

Figure 14:
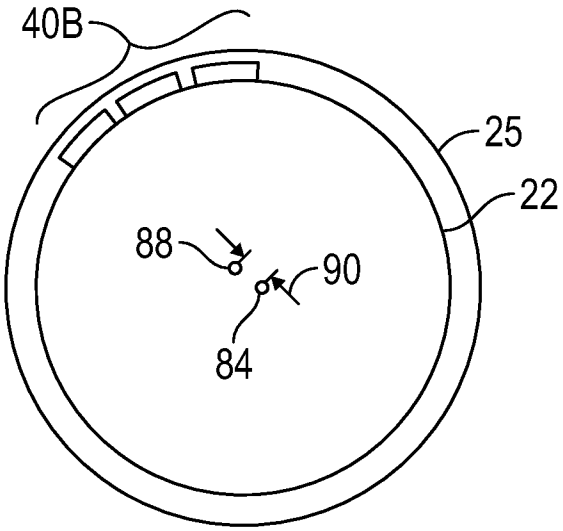
FIG. 14 is a schematic view of the example directional core drilling system orientated within a hole.
Figure 15:
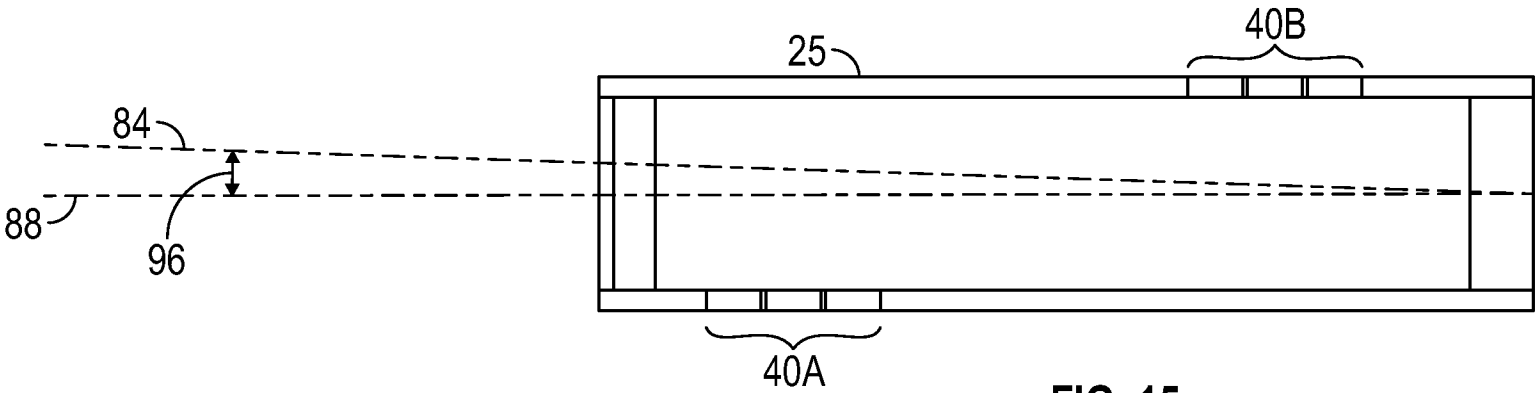
FIG. 15 is a schematic view of the example directional core drilling system orientated axially within a hole.

Referring to FIGS. 14 and 15 with continued reference to FIGS. 9-13, the groups of pads 40A, 40B contact the side of the borehole 25 at each location to generate an offset with respect to an axial center of the borehole 25. FIG. 14 shows a general central axis 84 of the DCD assembly 22 and an offset 90 relative a center axis 88 of the borehole 25. FIG. 15 shows an angle 96 of central axis 84 relative to the center axis 88 of the borehole 25. The angle 96 and offset 90 are exaggerated to illustrate the difference in orientation relative to the borehole 25. The offset 90 and angle 96 combine, in one disclosed embodiment, to provide a bend or bit tilt angle of less than 1° from the borehole central axis 88. In another disclosed embodiment, the steering pads 40A, 40B provide a bend in the hole of between ⅛° and ¼° from the borehole central axis 88. It should be appreciated that although example bend angles are disclosed by way of example, other angles are within the scope and contemplation of this disclosure.

Moreover, the orientation of the DCD assembly 22 to bend the borehole 25 can be modified by rotating the DCD assembly 22 about its axis to place the steering pads 40A, 40B at different positions. In this way, the DCD assembly 22 can be steered as desired to obtain core samples of certain portions of the earth.

Figure 16:
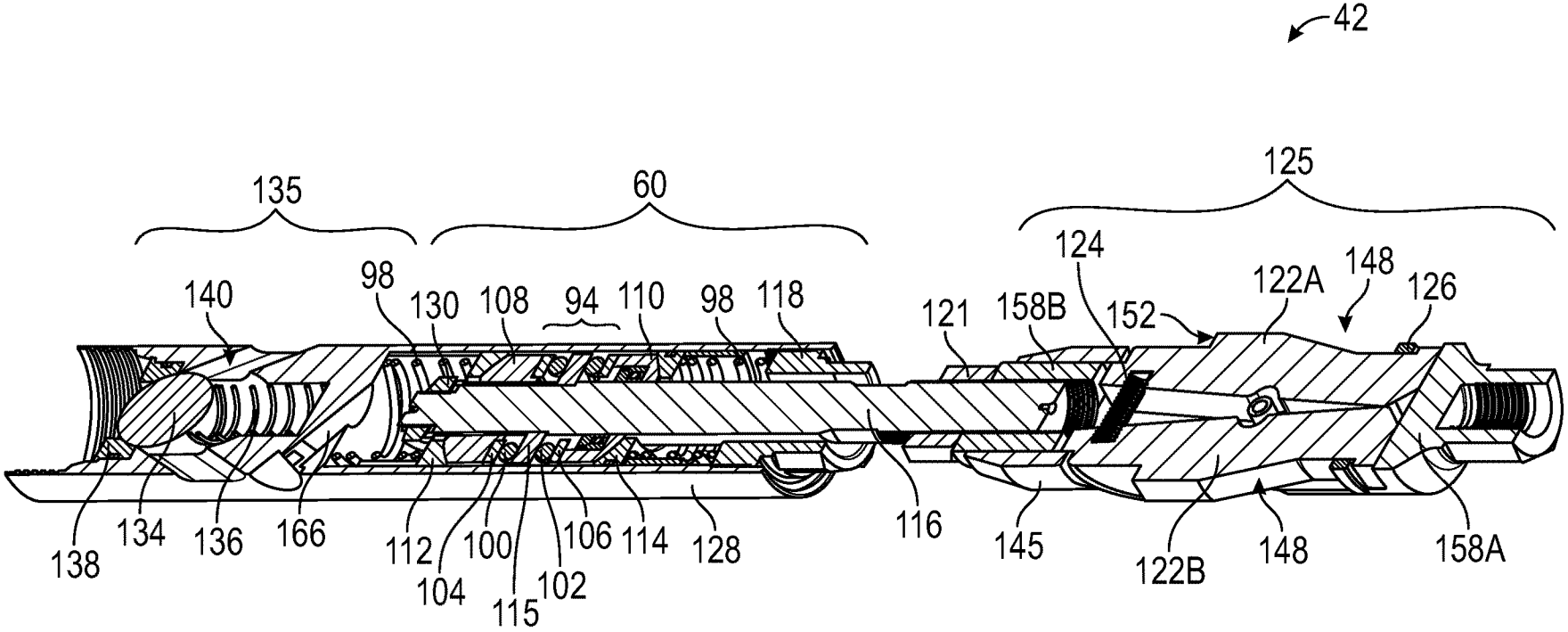
FIG. 16 is a sectional view of an example torque latch assembly embodiment.
Figure 17:
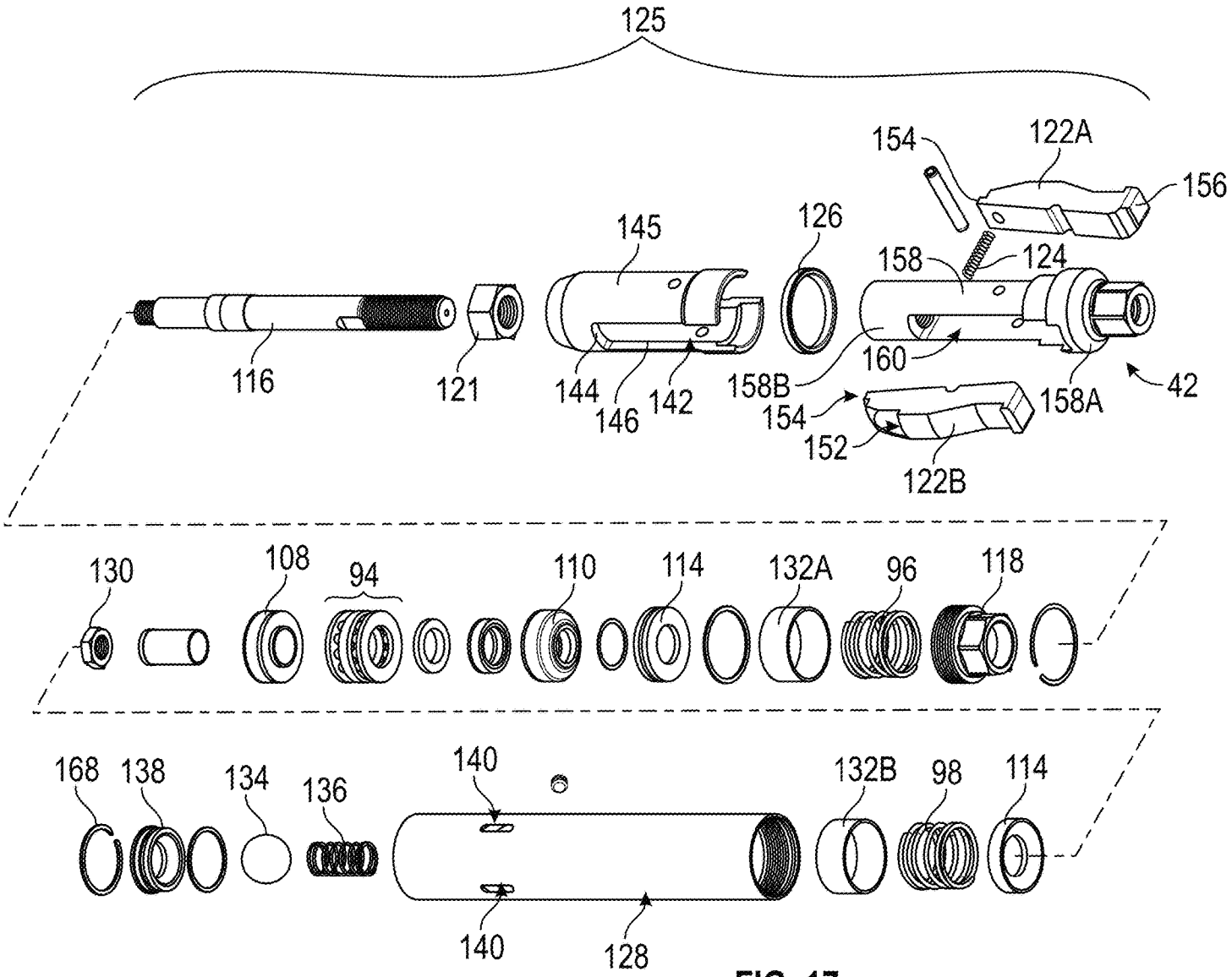
FIG. 17 is an exploded view of the example torque latch assembly embodiment.

Referring to FIGS. 16 and 17, the example drive coupling assembly 42 is shown and includes a check ball assembly 135, the anti-rotation thrust bearing assembly 60 and a torque latch assembly 125. The torque latch assembly 125 transmits rotational power from the mud motor 46 to the torque coupling 36A of the drive barrel assembly 36. The anti-rotation thrust bearing assembly 60 isolates the core barrel 38 from the torque transmitted by the torque latch assembly 125. The check ball assembly 135 controls flow of fluid during insertion and retraction of the DCD assembly 22.

Figure 18:
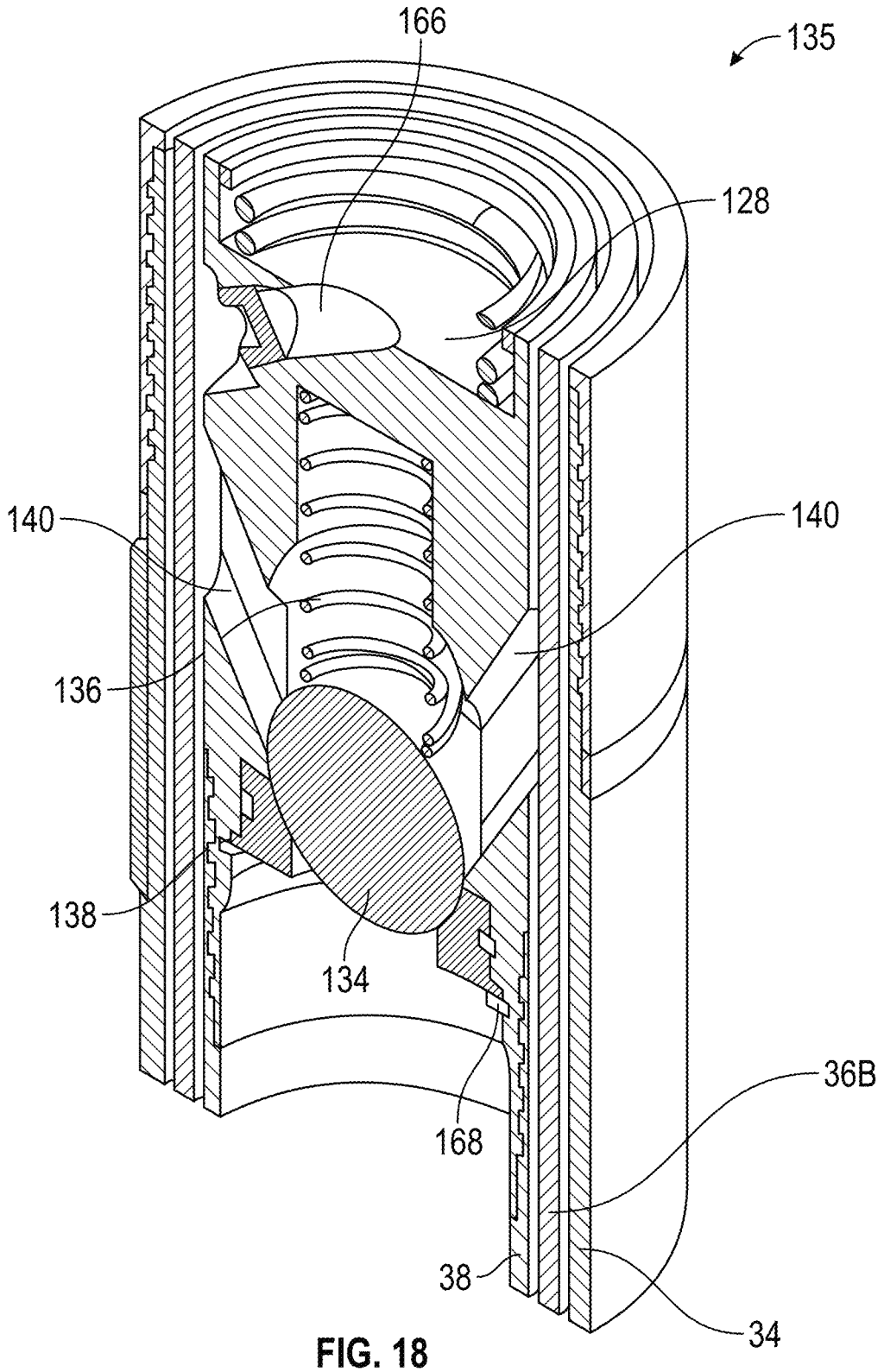
FIG. 18 is a sectional view of an example check valve assembly embodiment.

Referring to FIG. 18, with continued reference to FIGS. 16 and 17, the check ball assembly 135 is also included to control fluid flow during insertion and withdrawal of the DCD assembly 22. The check ball assembly 135 includes a check ball 134 biased against a ball seat 138 by biasing spring 136. The ball seat 138 is held within a housing 128 by a retaining ring 168. A seal is provided about the ball seat 138 to seal against inner walls of the housing 128.

During decent into the drill string 24, the check ball 134 is pushed off the ball seat 138 by the fluid flow entering the downstream end of the inner drive assembly 50. The fluid force overcomes the biasing force of the spring 136. Fluid thereby flows around the ball and out the housing 128 through flow openings 140. A plurality of flow openings 140 are provided such that fluid flows freely in a manner that does not slow the decent of the inner drive assembly 50 through the drill string 24.

Upon withdrawal of the inner drive assembly 50, with a core sample disposed within the core barrel 38, downstream of the check ball 134, the check ball 134 is closed and any fluid flow acts to maintain the check ball against the ball seat 138. The check ball 138 thereby prevents fluid flow from acting on a core sample as the DCD assembly 22 is pulled to the surface. By preventing fluid flow from impacting a core sample, the core sample is not damaged, nor contaminated. Moreover, the closed check ball 134 prevents the application of any fluid forces on the core sample that may act to dislodge the core sample from the DCD assembly 22.

Figure 19:
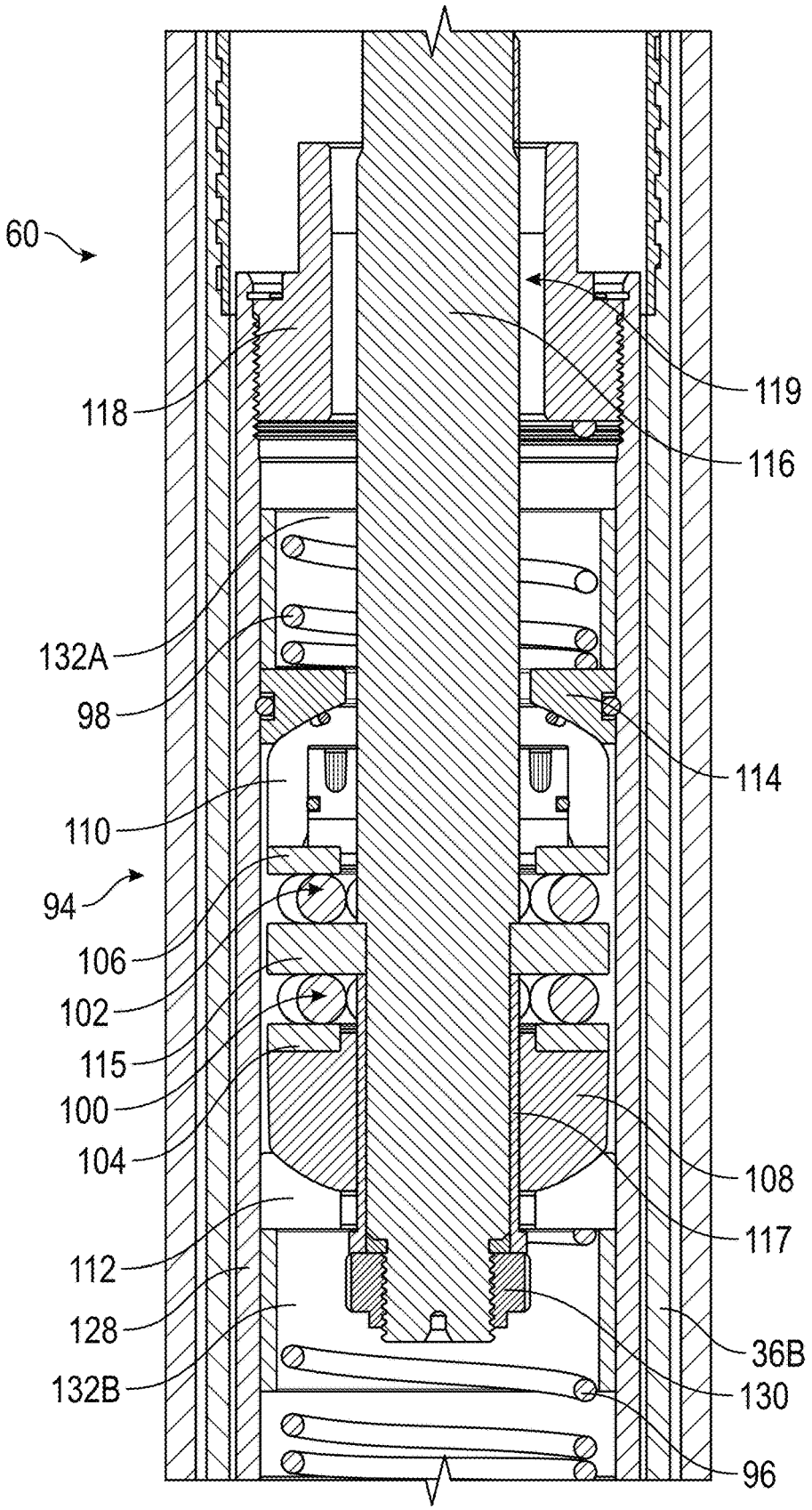
FIG. 19 is a cross-sectional view of an example double-acting thrust bearing assembly embodiment.

Referring to FIG. 19 with continued reference to FIGS. 16 and 17, the anti-rotation thrust bearing assembly 60 is disposed above the check ball assembly 135 and isolates the core barrel 38 from anti-rotation shaft 116 of the torque latch assembly 125. The anti-rotation thrust bearing assembly 60 includes a bearing assembly 94. The bearing assembly 94 includes a first group of ball bearings 102 and a second group of ball bearings 100 separated by a center washer 115 and disposed between an upper washer 106 and a lower washer 104. A lower spherical seat 108 is seated on a lower spring retainer 112. An upper spherical seat 110 is seated against an upper spring retainer 114. The upper and lower spherical seats 110, 108 share a coincident center of curvature which provides for the tilt of the anti-rotation shaft 116 with respect to housing 128. In other words, the upper and lower spherical seats 110, 108 combine to create a ball-joint-like operation and behavior.

A retaining nut 130 secures the center washer 115 to an end of the anti-rotation shaft 116 through a bushing 117. A lower bias spring 96 is disposed between a portion of the housing 128 and the lower spring retainer 112. An upper bias spring 98 is set between a nut 118 that is threaded into the housing 128. Each of the upper bias spring 98 and the lower bias spring 96 are disposed within a corresponding one of the spring sleeves 132A and 132B. The spring sleeves 132A-B maintain spring alignment on the corresponding spring retainers 112, and 114. The spring sleeves 132A-B also limit the maximum amount of compression of their corresponding springs, which controls the maximum axial displacement between anti-rotation shaft 116 and housing 128 in either direction. A nut 118 includes a central opening that is larger than the anti-rotation shaft 116 to provide an annular clearance 119. The annular clearance 119 provides for some side-to-side movement of the anti-rotation shaft 116 relative to the housing 128.

The upper spring 98 and the lower spring 96 provide a biasing force against the bearing assembly 94 to maintain rolling contact of the ball bearings 100, 102 against the corresponding upper and lower washers 106, 104 and the center washer 115. The force provided by the biasing springs 96, 98 on the bearing assembly 94 assures that the ball bearings 100, 102 roll along the bearing surfaces rather than skid or slide. Skidding or sliding of the ball bearings 100, 102 can result in premature wear during operation. The working travel of the upper spring 98 and the lower spring 96 are provided to accommodate relative movement between an outer barrel assembly and the inner drive assembly such that the force required to break the core sample is communicated directly to the core catcher 66. A grease passage 166 (FIG. 18) is provided through the housing 128 to enable filling of the anti-rotation thrust bearing assembly 60 with grease.

The anti-rotation thrust bearing assembly 60 isolates rotation of the anti-rotation shaft 116 relative to the core barrel 38 supported below the housing 128. The anti-rotation thrust bearing assembly 60 further accommodates relative axial and angular misalignments between the components of the inner drive assembly 50 and the core barrel 38 during retrieval of a core sample.

Figure 20:
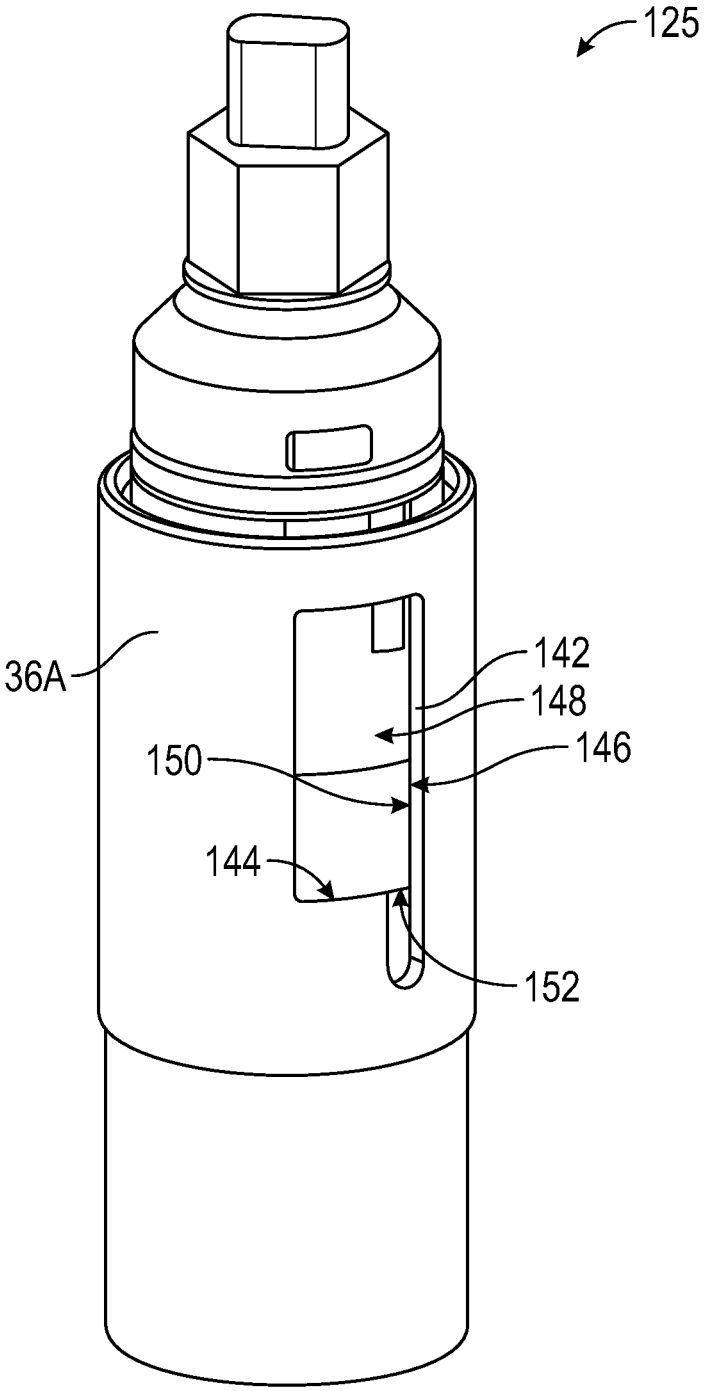
FIG. 20 is a perspective view of a portion of the example torque latch assembly embodiment.
Figure 21:
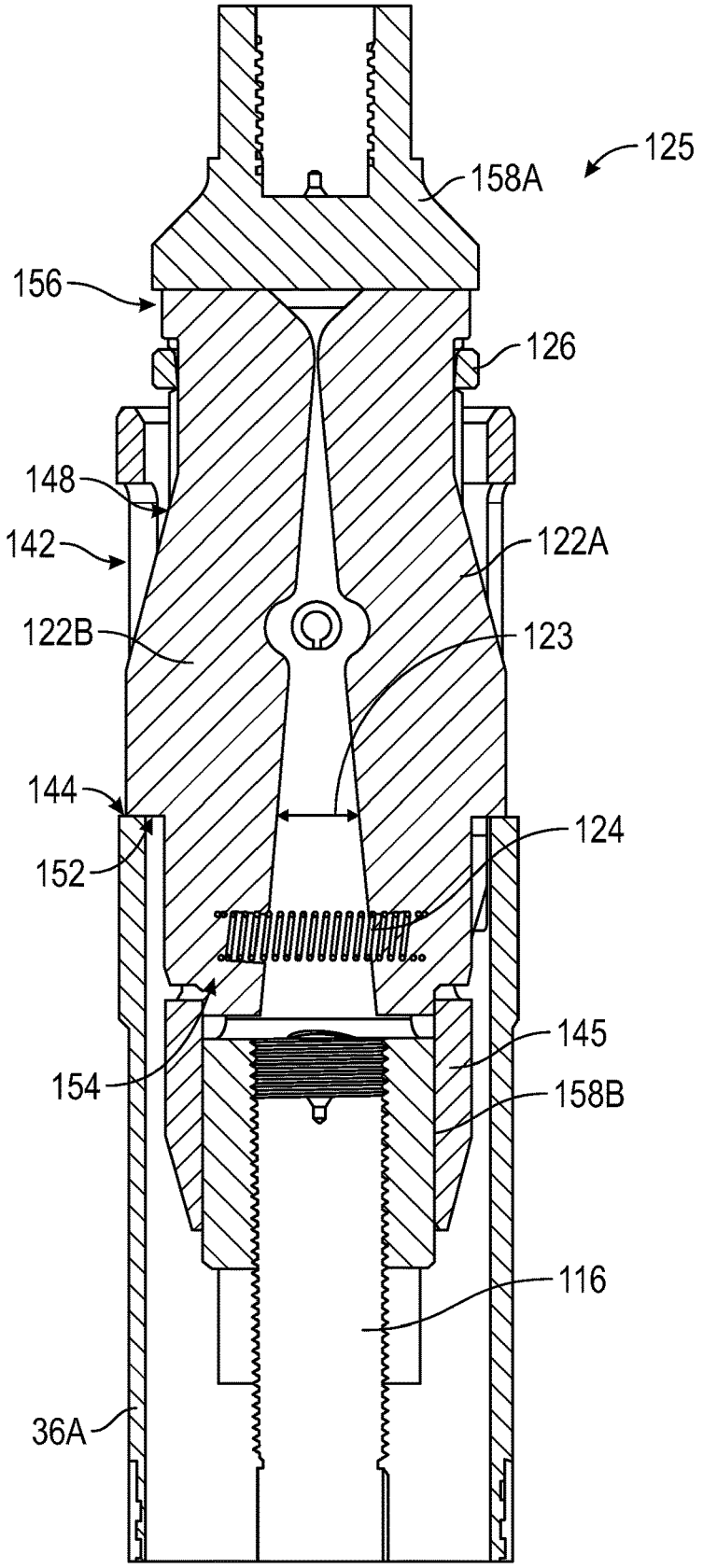
FIG. 21 is a cross-sectional view of another portion of the example torque latch assembly embodiment.

Referring to FIGS. 20 and 21 with continued reference to FIGS. 16 and 17, the torque latch assembly 125 includes the anti-rotation shaft 116 that is attached to lower end 158B of the torque latch body 158. The upper end 158A of the torque latch body 158 is coupled to a shaft of the thrust bearing assembly 44. The torque latch body 158 supports first and second latch arms 122A-B that are biased radially outward by spring 124. The latch arms 122A-B fit within corresponding slots 160 on either side of the torque latch body 158. The latch arms 122A-B include lower tabs 154 that are held within the slots 160 by a latch sleeve 145. The upper end of the latch arms 122A-B includes upper feet 156 that are held in place by a keeper ring 126.

The latch arms 122A-B are pivotal radially outward a radial distance sufficient for each latch arm 122A-B to pop into a drive slot 142 of the torque coupling 36A of the drive barrel assembly 36. The drive slot 142 includes an axial abutment surface 144 and a drive surface 146. Surfaces 152 of each of the latch arms 122A-B engage the axial surfaces 144 and transfer axial loads to the torque coupling 36A of the drive barrel assembly 36. A rotational drive surface 150 of each latch arm 122A-B engages the drive surface 146 of the slot to transfer torque to the torque coupling 36A and ultimately to the drill bit 30. Accordingly, the latch arms 122A-B includes surfaces 150 and 152 that transfers torque and axial loads to the drive barrel assembly 36 and ultimately to the drill bit 30.

The drive surfaces 150 and 152 are engaged upon rotation of the latch body 158 during an initial rotation. Downhole directed axial forces maintain the axial load on the latch arms 122A-B during operation. The latch arms 122A-B are movable within the corresponding slots 160 of the latch body 158. When under an axial load, the latch arms 122A-B abut an upper surface of each slot 160. Torque loads are transmitted through surfaces of the slots 160.

Once the drill bit 30 has advanced sufficiently through the earth to obtain a core sample of a desired length, the inner drive assembly 50 is pulled upward through the drill string 24. Because the torque latch assembly 125 is not accessible by traditional overshot assemblies, the drive surfaces of the latch arms 122A-B cannot be remotely unlatched. The disclosed latch arms 122A-B includes a ramped surface 148 that drives the latch arms 122A-B radially inward to disengage the drive slot 142 in response to axially upward movement. The latch arms 122A-B are configured to include a spacing 123 that accommodates inward radial movement of the latch arms 122A-B as they disengage the drive slot 142.

Figure 22:
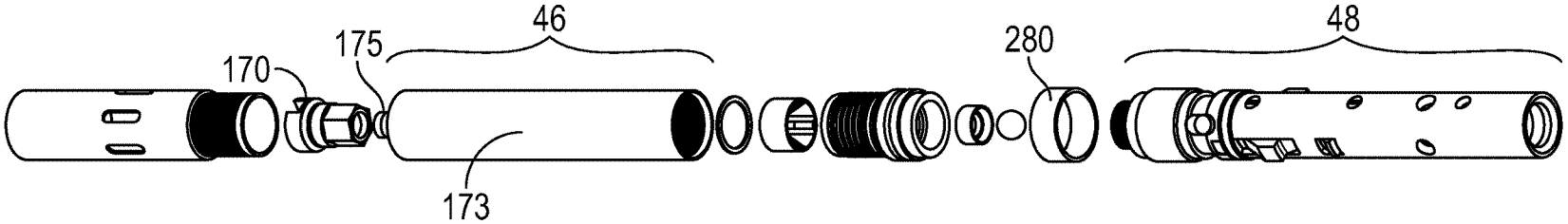
FIG. 22 is an exploded view of a portion of a motor and latch assembly of the inner drive assembly embodiment.
Figure 23:
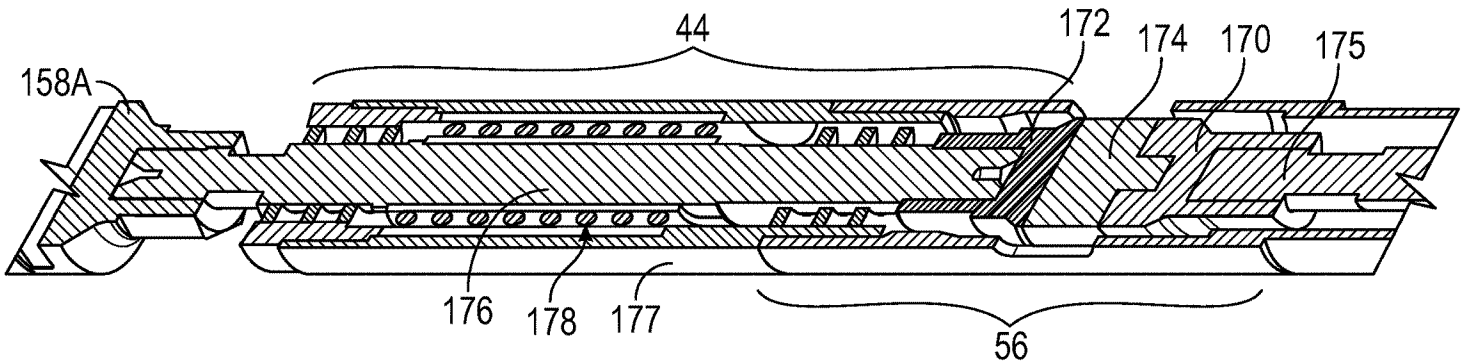
FIG. 23 is a sectional view of a portion of an example thrust bearing assembly.
Figure 24:
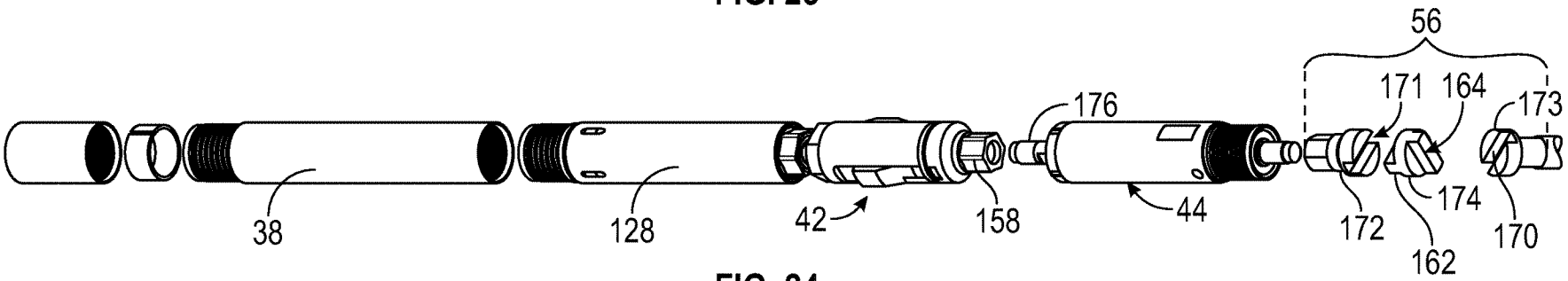
FIG. 24 is a sectional view of a torque latch assembly, the core barrel assembly of the inner drive assembly and the thrust bearing assembly.

Referring to FIGS. 22, 23 and 24, portions of the inner drive assembly 50 are shown to illustrate how each of the assemblies are coupled together. The mud motor 46 is coupled to the thrust bearing assembly by an Oldham style coupling 56. The coupling 56 includes a driven part 172 attached to a torque shaft 176 of the thrust bearing assembly 44. A drive part 170 is coupled to a rotor 175 driven by the mud motor 46. A center part 174 is disposed between the driven part 172 and the drive part 170 and includes tabs 162, 164 on either side that ride in corresponding slots provided in the driven part 172 and the drive part 170. The tabs 162, 164 of the center part 174 are perpendicular to each other.

The coupling 56 accommodates axial and rotational misalignment between the rotor 175 and the shaft 176. The driven part 172 includes a first transverse slot 171. The drive part 170 includes a second transverse slot 173. The center part 174 includes the first tab 162 that is received within the first transverse slot 171 and the second tab 164 that is received within the second transverse slot 173. The first tab 162 is orientated perpendicular to the second tab 164. The center part 174 is movable transverse to the axis or rotation of each of the drive part 170 and the driven part 172 to accommodate axial and rotational misalignment between the rotor 175 and shaft 176. The coupling 56 provides for the transmission of torque in accommodation of any parallel misalignment of the axis or rotation between the rotor 175 and the shaft 176. The coupling 56 transmits axial forces from rotor 175 to shaft 176 and thereby thrust bearing assembly 44.

The example mud motor 46 is powered by a fluid flow communicated through the drill string 24. Any known downhole powered mud motor 46 may be utilized within the scope and contemplation of this disclosure. The example mud motor 46 generates an orbiting eccentric movement in the rotor 175. The coupling 56 accommodates the orbiting rotary motion and transfers the orbiting motion into an axial rotation of the shaft 176 and thereby the latch coupling 158.

The thrust bearing assembly 44 supports the axial forces that are applied to the drill bit 30 while also transmitting torque to the torque latch assembly 125. The thrust bearing assembly 44 includes a plurality of bearing assemblies 178 stacked axially in an annular space between the shaft 176 and a housing 177. The disclosed thrust bearing assembly 44 is sealed such that fluid and contaminants are prevented from entering and fouling the bearing assemblies 178.

The specific configuration of the thrust bearing assembly 44 may vary from the illustrated arrangement to include other known bearing configurations capable of accommodating and transferring the applicable axial loads. Accordingly, other thrust bearing assemblies as are known to those skilled in the art could be utilized and are within the scope and contemplation of this disclosure.

The disclosed inner drive assembly 50 thereby includes a core barrel 38 that is coupled to a housing 128 that includes the example anti-rotation thrust bearing assembly 60. The anti-rotation thrust bearing assembly 60 isolates rotational forces generated by the torque latch assembly 125 from the core barrel assembly 38. Accordingly, the housing 128 and the core barrel 38 do not rotate. The torque latch assembly 125 is coupled to the thrust bearing assembly 44 by the threaded interface between the shaft 176 and the upper end 158A of the latch body 158. The shaft 176 is driven by the mud motor 46 through the coupling 56. The mud motor 46 is coupled to the latch assembly 48. The latch assembly 48 includes features that cooperate with an overshot assembly (not shown) that enables release and retrieval of a core through the drill string 24.

Figure 25:
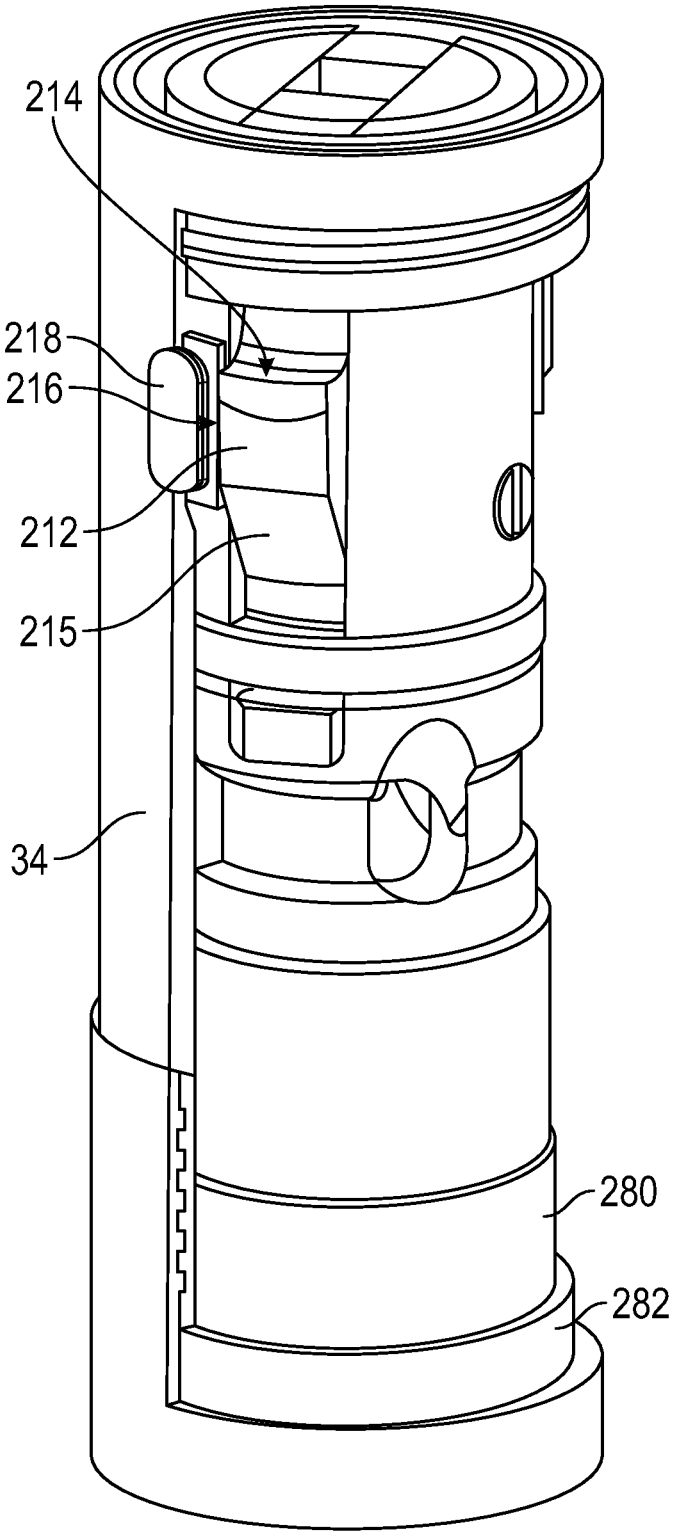
FIG. 25 is a sectional view of a portion of a latch assembly and outer barrel assembly.
Figure 27:
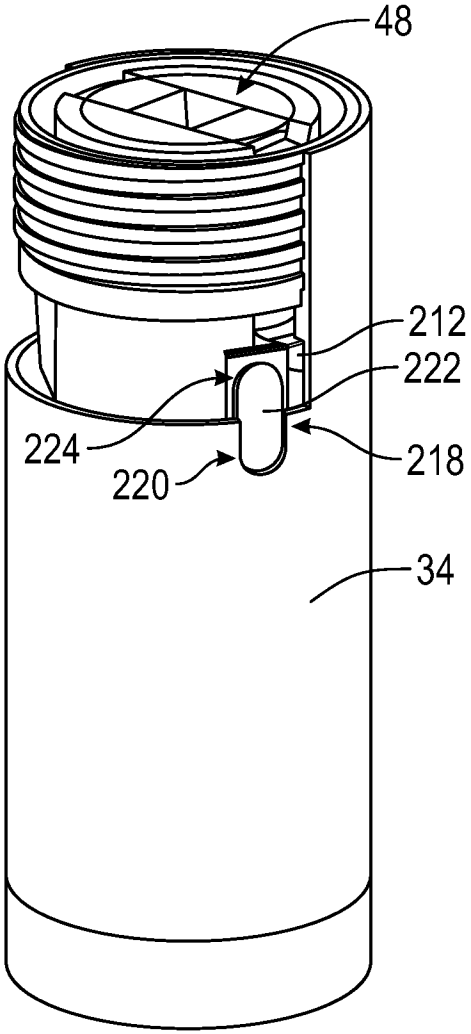
FIG. 27 is another sectional view of the interface between the latch assembly and the outer barrel assembly.
Figure 26:
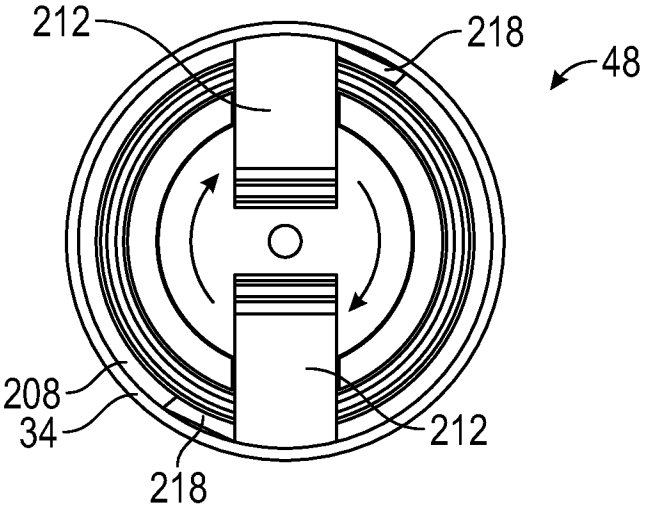
FIG. 26 is a sectional view of an interface between the latch assembly and the outer barrel assembly.

Referring to FIGS. 25, 26, and 27, the outer barrel 34 includes an inner circumferential groove 208 and the latch assembly 48 includes outwardly biased lugs 212. The lugs 212 expand radially outward into the circumferential groove 208 and include a top surface 214 that abuts a downhole shoulder 210 (Shown in FIG. 6) of the circumferential groove 208. Abutment between the lugs 212 and the downhole shoulder 210 provide for axial forces to be exerted on the outer barrel 34. The lugs 212 includes a downhole ramped surface 215 that pushes the lugs 212 radially inward when descending downhole through the drill string.

An outer landing ring 282 is secured to the outer barrel assembly 34 and fixes a downward limit to the axial location of the inner drive assembly 50 within the drill string 22. An inner landing ring 280 is attached to the inner drive assembly 50 and abuts the outer landing ring 282. The lugs 212 then fix an upward limit of the axial position of the inner drive assembly 50 and thereby the core barrel 38 within the outer barrel assembly 34.

The outer barrel 34 further includes anti-rotation keys 218 disposed within openings 220 of the circumferential groove 208 to counteract rotational forces produced by the mud motor 46. The lugs 212 rotate within the circumferential groove and abut the anti-rotation keys 218 to anchor the drive assembly 50 to the outer barrel 34. The anti-rotation keys 218 counter rotational forces generated by the mud motor 46.

The disclosed example anti-rotation keys 218 are inset into openings 220 defined through the outer barrel 34 within the circumferential groove 208. In this disclosed example, two anti-rotation keys 218 are provided and spaced circumferentially apart such that each of the lugs 212 abuts a different anti-rotation key 218.

Each anti-rotation key 218 includes a boss portion 222 and a flange portion 224. The boss portion 222 is fit into the opening 220 within the outer barrel 34 and the flange 224 is disposed on an inner surface of the circumferential groove 208. The lugs 212 include a side 216 that abut sides of the flange portion 224 to stop rotation relative to the outer barrel 34.

As appreciated, although a specific configuration of an anti-rotation key is shown by way of example, other shapes and sizes could be utilized and are within the scope and contemplation of this disclosure. Furthermore, although two anti-rotation keys are shown, any number of anti-rotation keys could be utilized and are within the scope and contemplation of this disclosure. Accordingly, the disclosed latch assembly 48 provides for transmission of axial forces to the outer barrel 34 and counters rotational forces generated by the drive assembly 50.

Referring to FIGS. 28, 29, 30, 31 and 32, the mud motor 46 is driven by a fluid flow that is pumped through the drill string 24. Fluid flow is communicated to the mud motor 46 to drive the shaft 175. Rotation of and the torque output through the shaft 175 is controlled by a pressure differential between entering and exit fluid flow through the mud motor 46. Fluid flow is also utilized at the drill bit 30 to aid in cutting through the earth.

A portion 230 of the outer barrel assembly 34 includes an exhaust shroud 236 for directing fluid flow axially uphole. The portion 230 surrounds the mud motor 46 such that a portion of fluid exhausted from the mud motor 46 exits through flow channels 246 and out through a top opening 238 defined by the exit shroud 236. In this disclosed example, two exhaust shrouds 236 are provided to accommodate the desired exhaust fluid flow. It should be understood that additional exhaust shrouds may be utilized and included within the contemplation and scope of this disclosure.

In this disclosed example embodiment, the exhaust shroud is assembled as two parts 236A and 236B around the portion 230. The shroud parts 236A and 236B include ribs 240 that abut the external surface of the portion 230 to provide a desired rigidity and durability.

Figure 28:
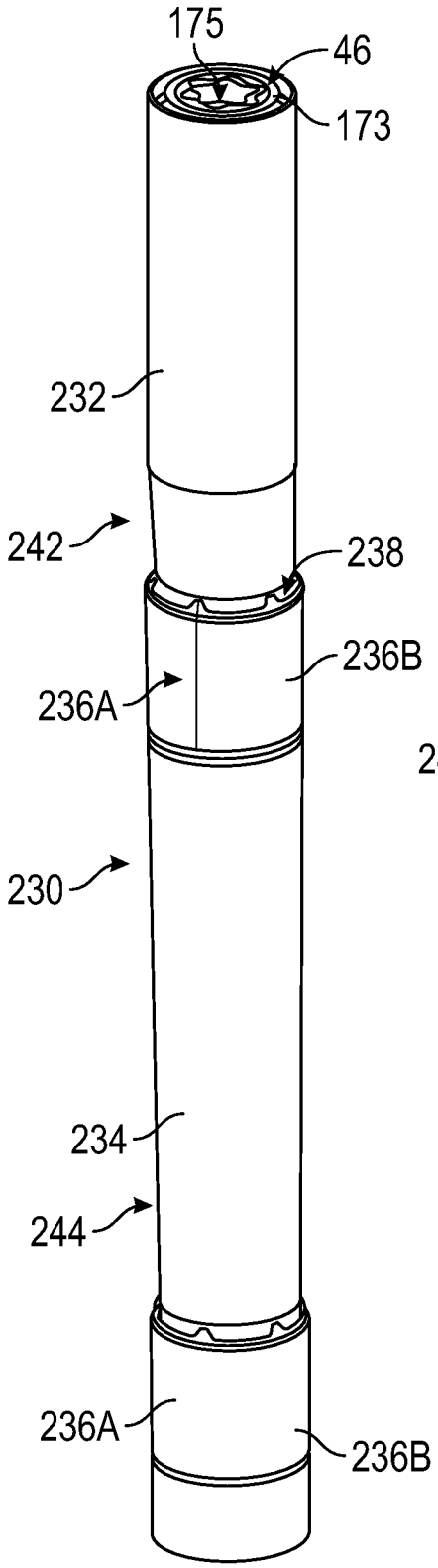
FIG. 28 is a perspective view of a portion of an outer barrel assembly and exhaust shroud.
Figure 29:
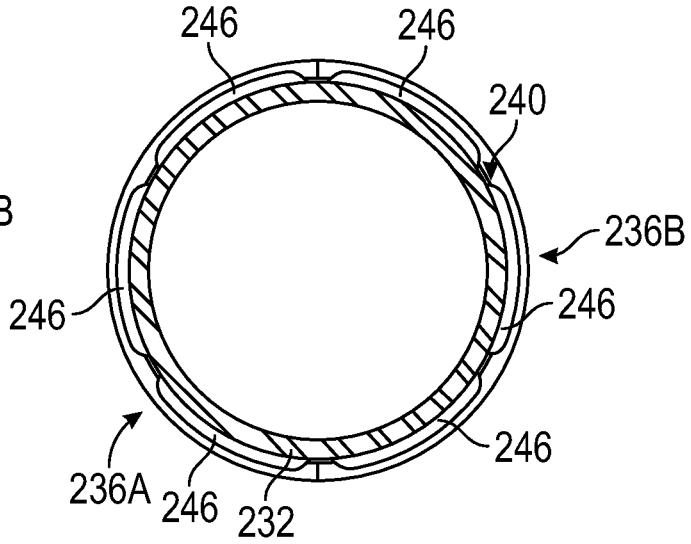
FIG. 29 is a cross-section of an example exhaust shroud.
Figure 30:
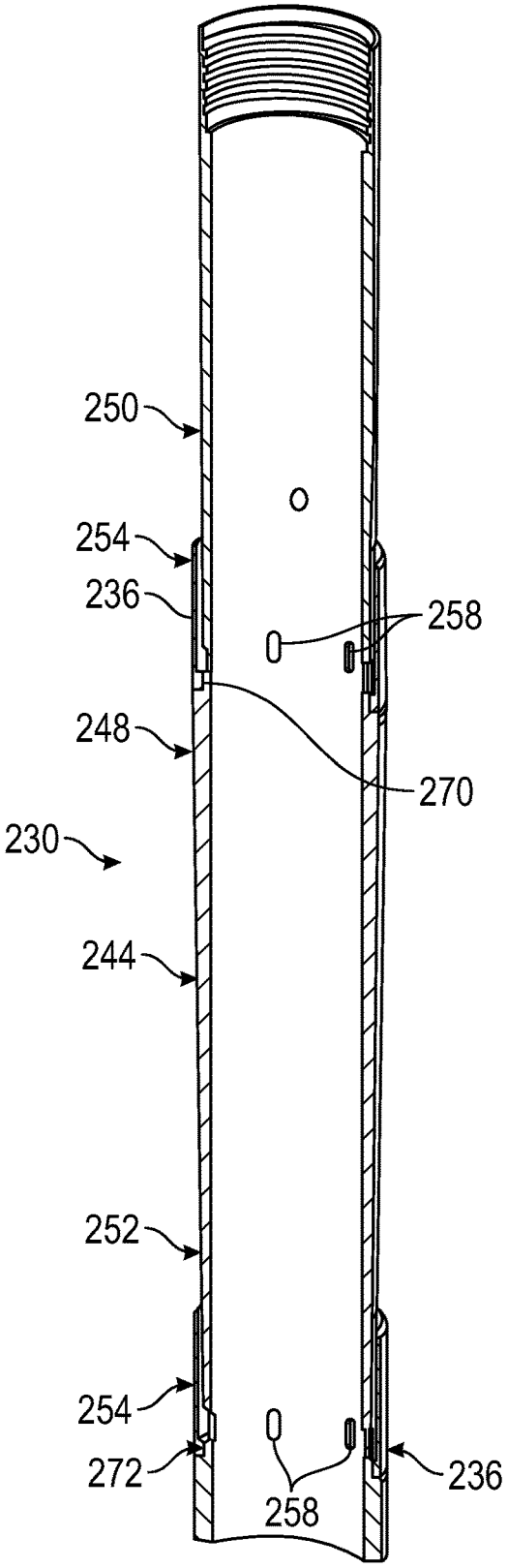
FIG. 30 is a cross-section of a portion of the outer barrel assembly proximate an exhaust shroud.
Figure 31:
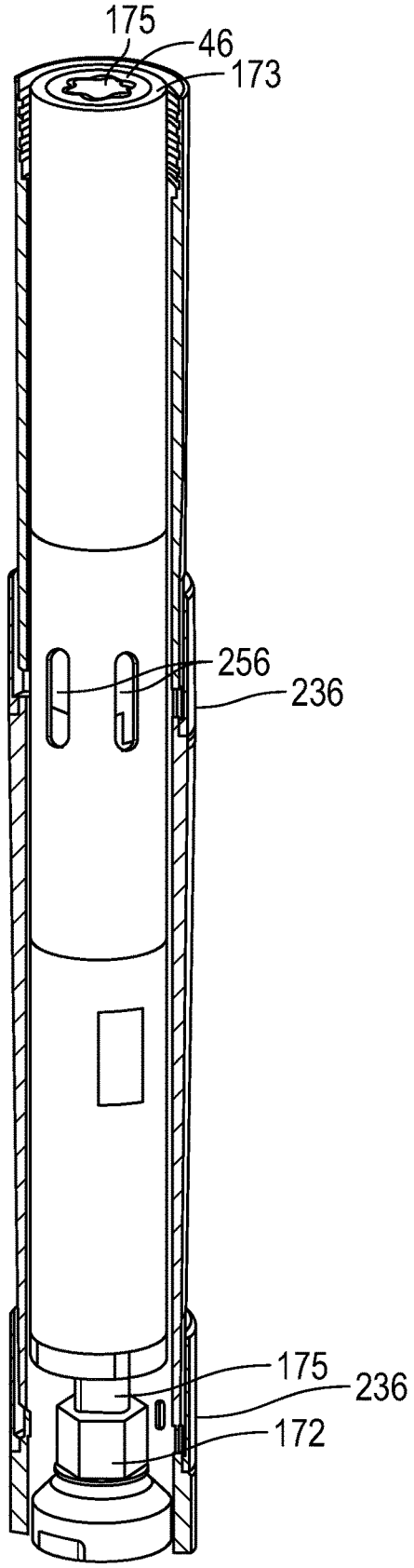
FIG. 31 is a partial sectional view of a motor within the outer barrel assembly proximate an exhaust shroud.

The portion 230 includes a first taper 242 that transitions from an upper part 232 to a reduced diameter that is covered by the exhaust shroud parts 236A and 236B. A second taper 244 is provided along a lower part 234 to provide a reduced diameter proximate the second, lower shroud 236 as shown in FIG. 28. The first taper 242 includes a gradually decreasing diameter 250 (FIG. 30) that extends to a shoulder 270 upon which the shroud 236 is assembled. Each of the shrouds 236 include an outer diameter 254 that corresponds with the diameter of the outer barrel assembly 34. The second taper 244 includes a decreasing diameter 252 from the diameter 248. The diameter 248 is the same as the outer diameter 254 of the upper shroud 236 as shown in FIG. 30. The diameter 252 tapers radially inward to the shoulder 272 on which the lower shroud 236 is assembled.

Slots 258 are provided through the portion 230 and are in fluid communication with the channels 246 defined by each corresponding exhaust shroud 236. The openings 256 communicate fluid to the inner surface of the portion 230. In one disclosed example embodiment, the openings 256 are elongated rectangular slots that extend axially and are rounded at top and bottom sides. Any number of slots 258 and openings 256 may be provided within the contemplation and scope of this disclosure. The size and number of slots 258 and openings 256 provide a desired pressure differential for operation of the mud motor 46. Moreover, the number of slots 258 and openings 256 are selected to minimize any back pressure that may inhibit desired operation of the mud motor 46.

Figure 32:
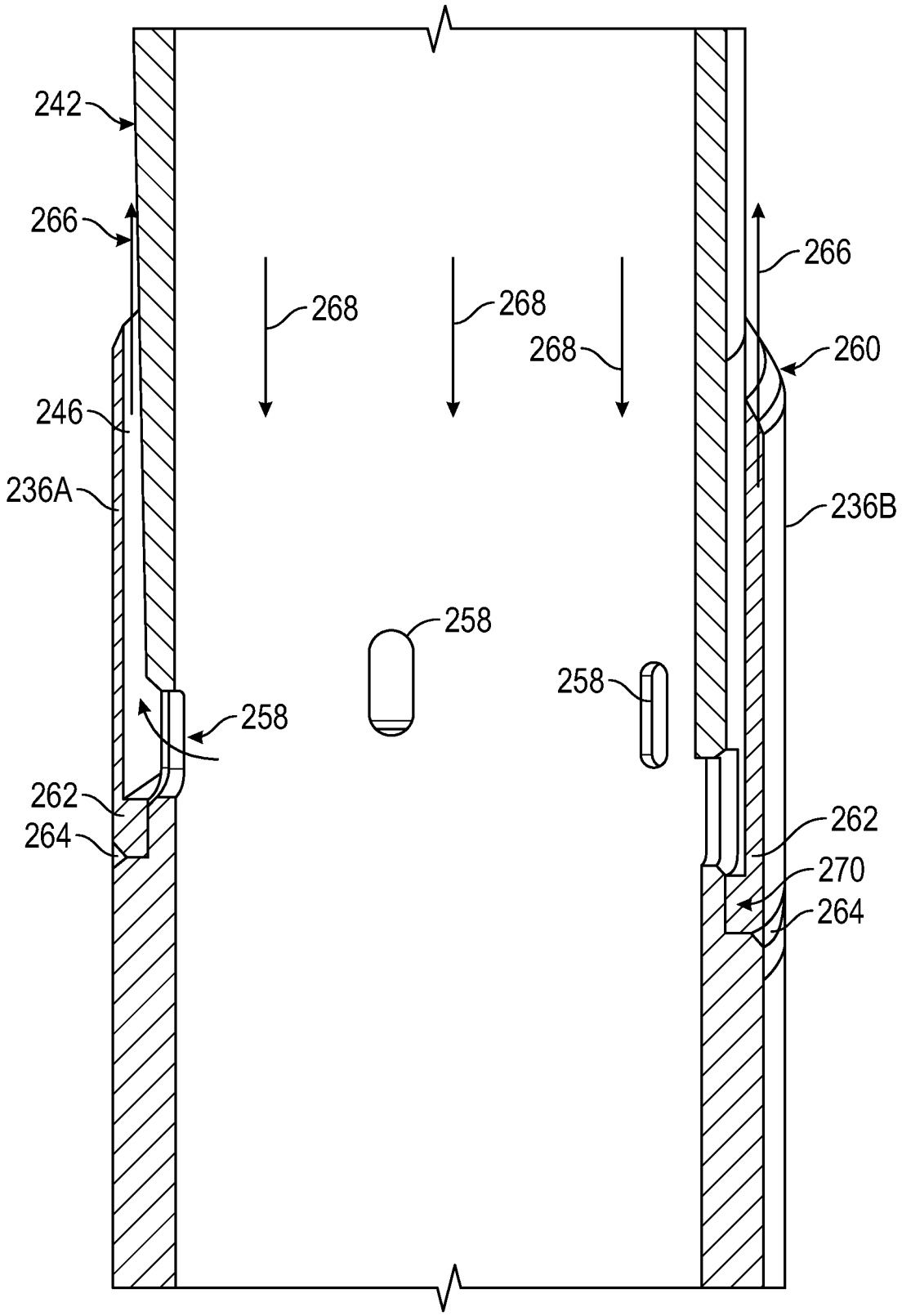
FIG. 32 is an enlarged cross-section of fluid exhaust openings and fluid passages through an exhaust shroud.
Figure 34:
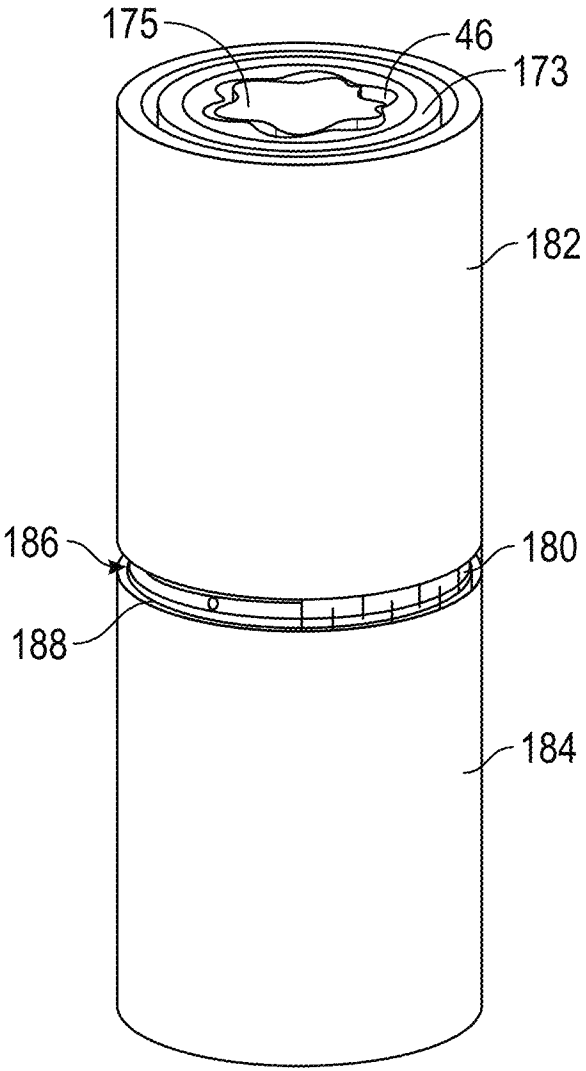
FIG. 34 is a partial sectional view of the example fluid flow metering assembly.
Figure 33:
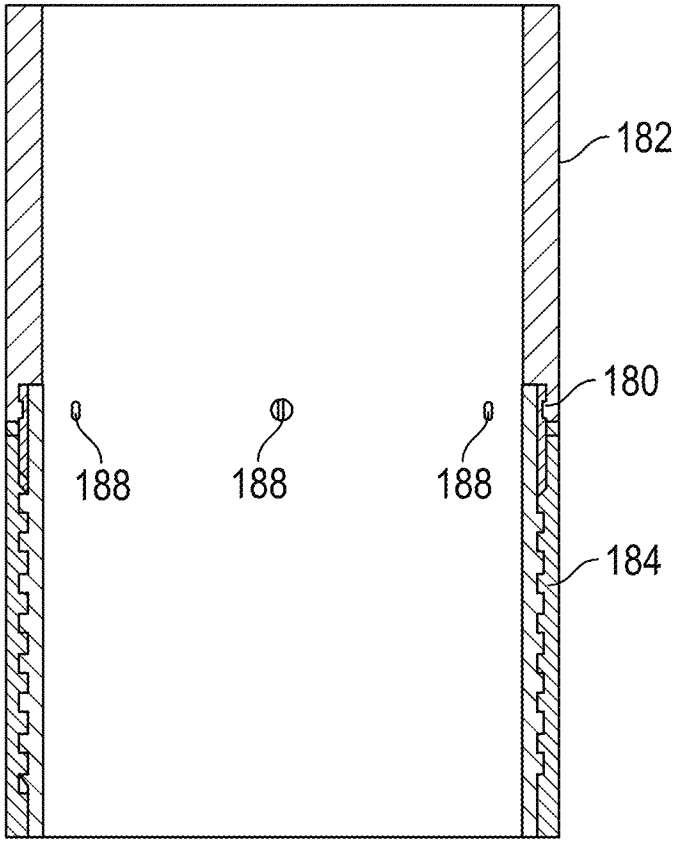
FIG. 33 is a sectional view showing an inner surface of an example fluid flow metering assembly.
Figure 35:
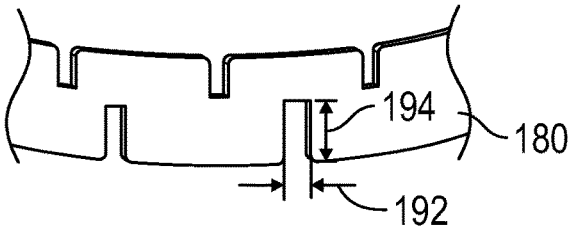
FIG. 35 is an enlarged view of the example fluid flow metering ring.
Figure 36:
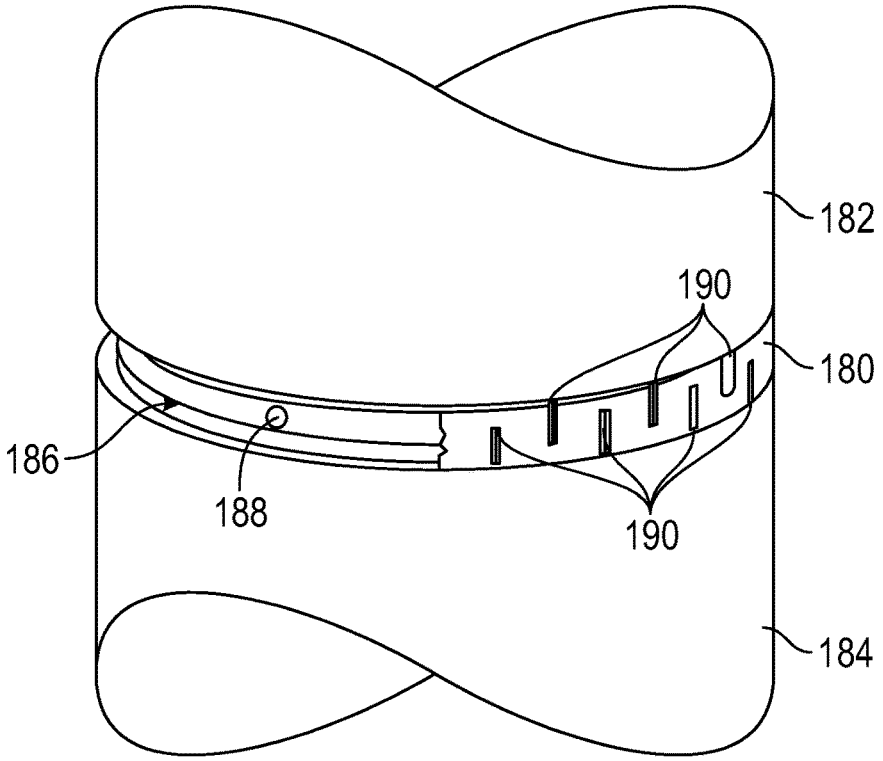
FIG. 36 is an enlarged view of a portion of a metering ring.
Figure 37:
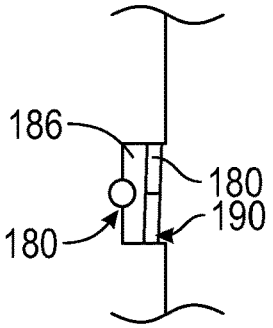
FIG. 37 is an enlarged schematic view of the example fluid flow metering assembly.

Referring to FIG. 32 with continued reference to FIGS. 28, 29, 30 and 31, an enlarged cross-section is shown to illustrate fluid flow. An inner fluid flow schematically indicated at 268 is present within the portion 230 and exits radially outward through slots 258. The fluid flow is responsive to fluid pressure provided to drive the mud motor 46. The pressure is generated by the flow communicated from the surface to drive the mud motor 46. The inner fluid flow 268 may include radial and axial components that are driven through the slots 258. The internal pressure of the flows 268 drive it radially outward through the slots 258.

The radially directed flows 268 are communicated into channels 246 defined by the exhaust shroud 236 and turned axially uphole as an axial flow schematically shown at 266. The axial flow 266 exits along the outer surface of the portion 230 and along the tapered surface 242 in this example. The shroud 236 prevents the flow from radially impacting the surrounding surfaces of the bore hole. Because the flow is at an elevated pressure, radial impact of the pressurized flow could detrimentally disturb surfaces of the bore hole and complicate operation. The example exhaust shrouds 236 turn this pressurized flow axially uphole to reduce and/or eliminate any such impact.

In one disclosed example embodiment, the exhaust shrouds 236 are formed as two parts 236A and 236B that have a base portion 262 that seat on the shoulder 270 of the portion 230. The two parts 236A and 236B are joined together and to the portion 230 by a weld schematically shown at 264. The welds 264 are finished to provide a smooth outer surface of a diameter common to the diameter of the shrouds 236. Each shroud part 236A, 236B includes a top taper 260 along an outer periphery to ease movement when removed from the bore hole. The taper 260 reduces and/or prevents catching on inner surfaces of the bore hole when removed.

Referring to FIGS. 33, 34, 35, 36 and 37, another fluid exhaust embodiment is shown and includes bypass openings 188. The bypass openings 188 are disposed in a portion of the outer barrel assembly 34. A first portion 182 and a second portion 184 of the outer barrel assembly 22 are shown coupled together by a threaded interface.

The bypass openings 188 communicate fluid flow into an outer annular channel 186. The outer annular channel 186 is covered by a metering ring 180. The size and number of the bypass openings 188 combine to define a flow area that is significantly larger than a calibration flow area that regulates the fluid flow.

The metering ring 180 is disposed within the annular channel 186 and includes a plurality of slots 190. Each of the slots 190 include a height 194 and a width 192. The height 194 and the width 192 define a flow area for calibrating and controlling the bypass fluid flow. The annular channel 186 and the openings 188 combine to provide a flow area that is much less restrictive than the combined flow areas defined by the slots 190 of the metering ring 180.

In this disclosed example, the metering ring 180 is held between the first portion 182 and the second portion 184 within the annular channel 186. Fluid flow from within the first and second portions 182, 184 passes through the plurality of openings 188 into the annular channel 186. The fluid flow then passes through the plurality of slots 190 and into an annular space surrounding the DCD assembly 22 into the borehole 25. The fluid may then flow uphole and return to the drill rig at the surface. In this example, the metering ring 180 is disposed within the outer barrel assembly 34 in a location proximate to the mud motor 46. Moreover, several metering rings 180 may be disposed at any location within the DCD assembly 22 that requires control of fluid pressure.

Figure 38:
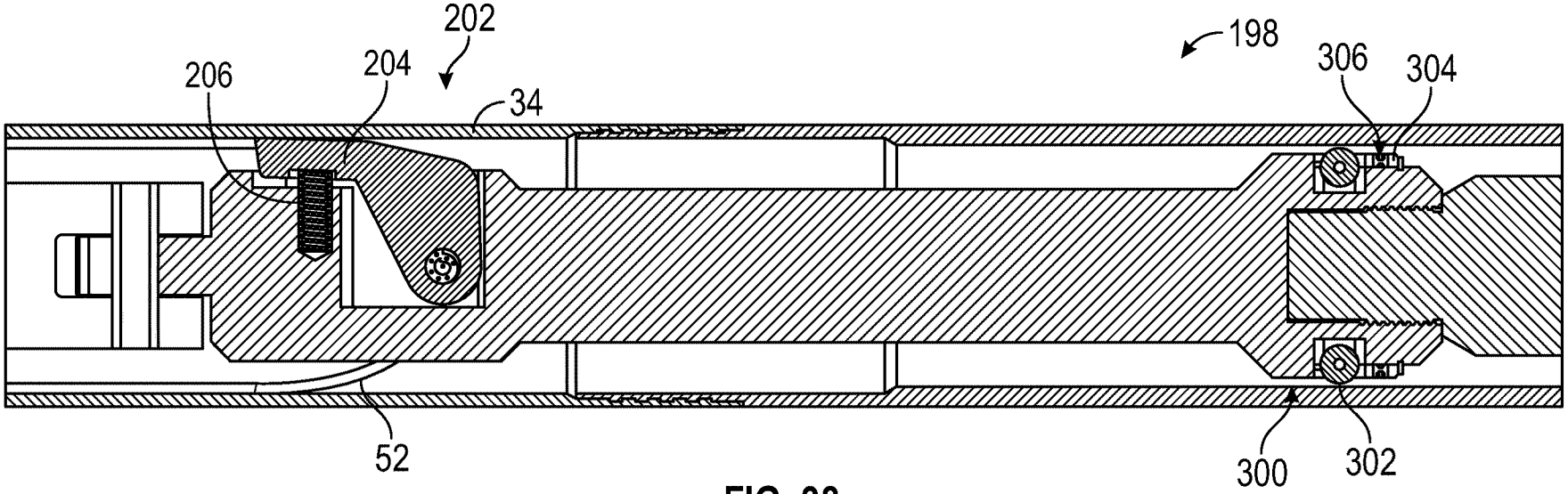
FIG. 38 is a sectional view of a portion of a retrieval assembly.
Figure 39:
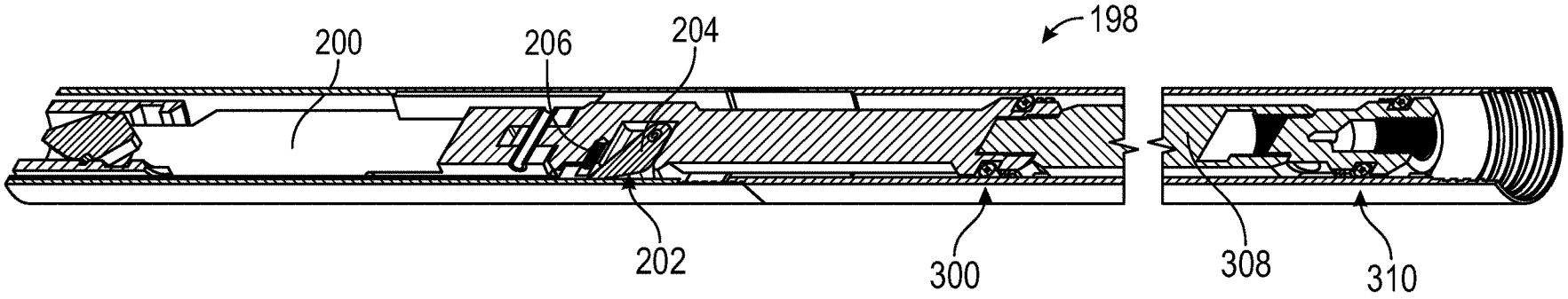
FIG. 39 is a cross-sectional view of the retrieval assembly.

Referring to FIGS. 38 and 39, a retrieval assembly 198 is shown and includes a release actuator 200 that engages a portion of the latch assembly 48 to release a latch coupling the DCD assembly 22 to the outer barrel assembly 34. The retrieval assembly 198 includes a key assembly 202 that engages a guide slot 52 defined on an inner surface of the outer barrel assembly 34. The key assembly 202 guides along the guide slot 52 to rotationally orientate the retrieval assembly 198 to the DCD assembly 22. Axial withdrawal of the release actuator 200 causes a release from the outer barrel assembly 34 and a coupling of the DCD assembly 22 to the release assembly 198 such that the inner drive assembly 50 may be pulled to the surface.

The key assembly 202 includes a movable key portion 204 that is moveable radially inward to accommodate portions of the drill string 24 and the outer barrel assembly 34 that may be of a smaller diameter than the guide slot 52. A biasing member 206 is provided to bias the movable key portion 204 outward into the guide slot 52.

A first centralizer 300 is attached to an end of the release actuator 200 to center the release actuator 200 within the drill string 24 and outer barrel assembly 34. A sensor assembly 308 is secured to the first centralizer 300 on a first end and to a second centralizer 310 at a second end. The sensor assembly 308 may be of any configuration known to provide information indicative of the position and orientation of the DCD 22. Each of the first and second centralizers 300, 310 includes wheels 302 that are supported on shafts and extend radially outward to engage an inner surface of the drill string 24 and the outer barrel assembly 34. The wheels 302 and corresponding shafts are held in slot 312 by a ring 304. The ring 304 is rotational secured by fasteners 306 and axially secured by a retaining ring. The axial distance between the first centralizer 300 and the second centralizer 310 positions the key assembly 202 to assure engagement.

Figure 42:
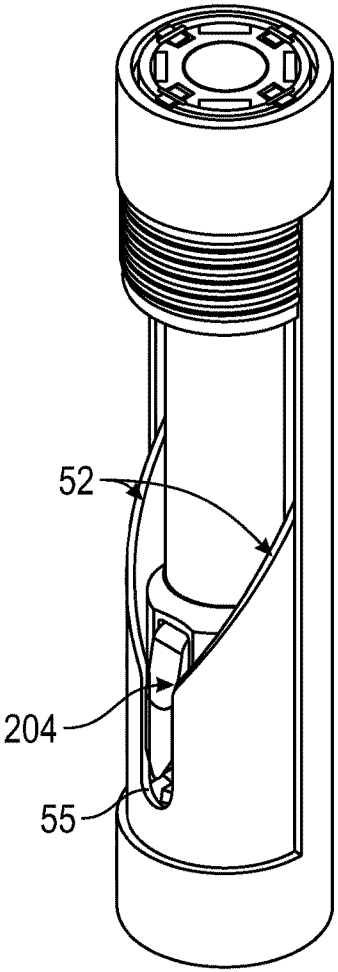
FIG. 42 is a sectional view of the retrieval assembly disposed within an axial portion of the guide slot.
Figure 41:
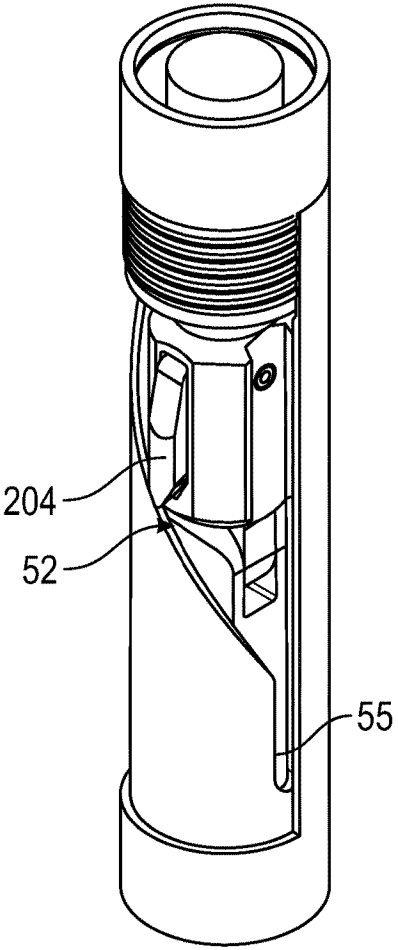
FIG. 41 is a sectional view of the retrieval assembly engaged to the guide slot.
Figure 40:
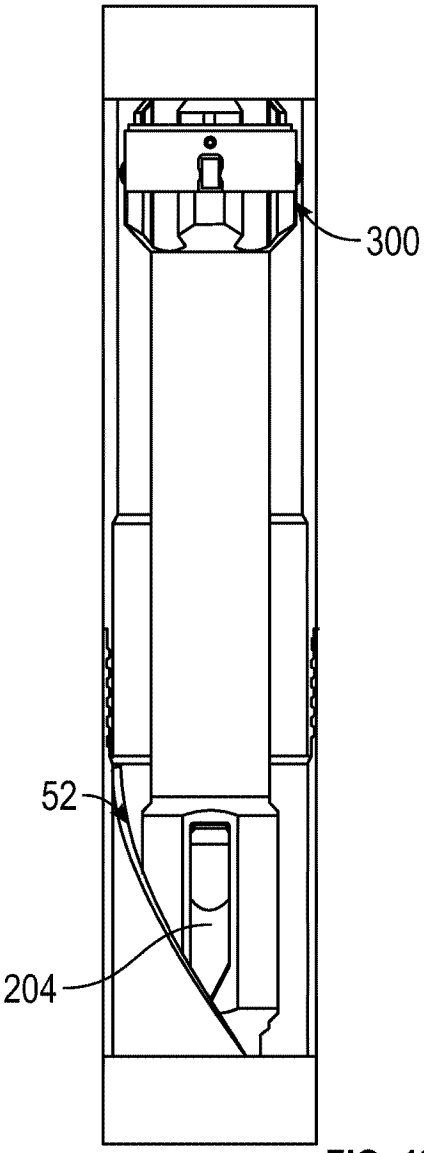
FIG. 40 is a sectional view of the retrieval assembly with a portion initial engaged to a guide slot.

Referring to FIGS. 40, 41 and 42 with continued reference to FIGS. 38 and 39, the guide slot 52 is configured as a helix that leads into an axial slot 55. The movable key portion 204 engages the helix portion of the guide slot 52 upon axial movement and guides along the slot 52 and thereby rotate the retrieval assembly 198 as is best shown in FIGS. 40-42. The movable key portion 204 then moves into the axial slot 55 (FIG. 34) to provide the desired alignment. The axial slot 55 provides a circumferential reference point that is used to circumferentially locate a downhole orientation device as is commonly used in directional drilling and known by those skilled in the art. For example, the circumferential position of the axial slot 55 is used to orient the steering pads 40 in order to direct further boring into the earth in a desired direction.

Figure 43:
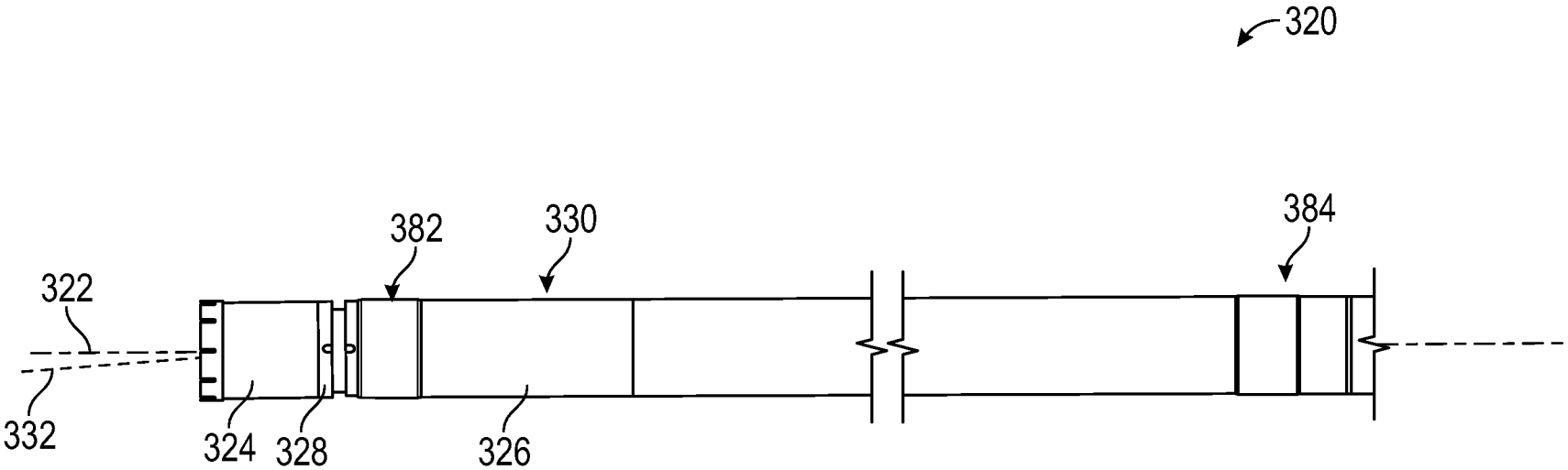
FIG. 43 is an exterior view of another directional core drilling assembly.

Referring to FIG. 43, another directional core drilling (DCD) assembly 320 is shown and includes a drill bit 324 that cuts into the earth, stone, and rock to form the borehole. An outer barrel assembly 326 includes an outer surface 330 without additional steering pads or features. The example DCD assembly 320 is generally disposed along a central axis 322 with the drill bit 324 disposed on a guide axis 332. The guide axis 332 is angled relative to the central axis 322 and provides for generation of the borehole at a desired angle that is not straight. The example DCD assembly 320 may include all the internal drive, latching and retrieval features described above with regard to the DCD assembly 22. Other combinations and devices could also be included in the DCD assembly 320 and remain within the contemplation and scope of this disclosure.

Figure 44:
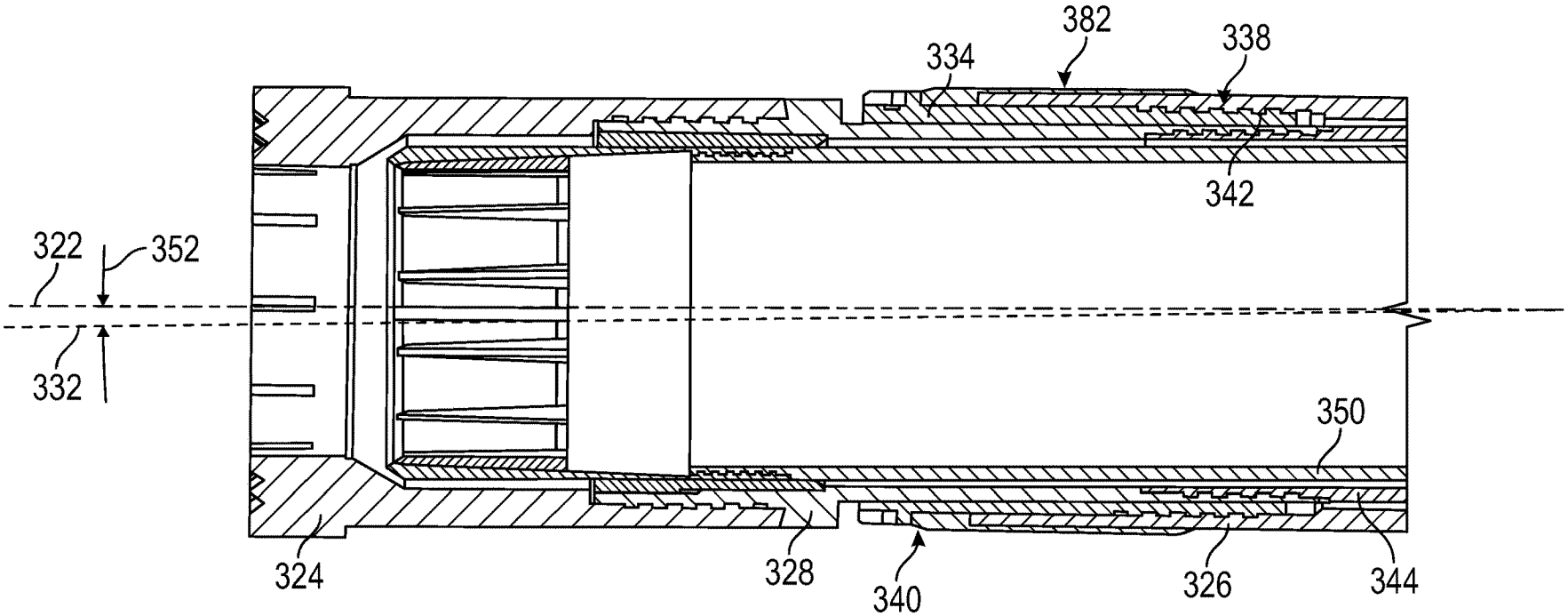
FIG. 44 is an enlarged cross-sectional view of a downhole portion of the core drilling assembly of FIG. 43.
Figure 45:
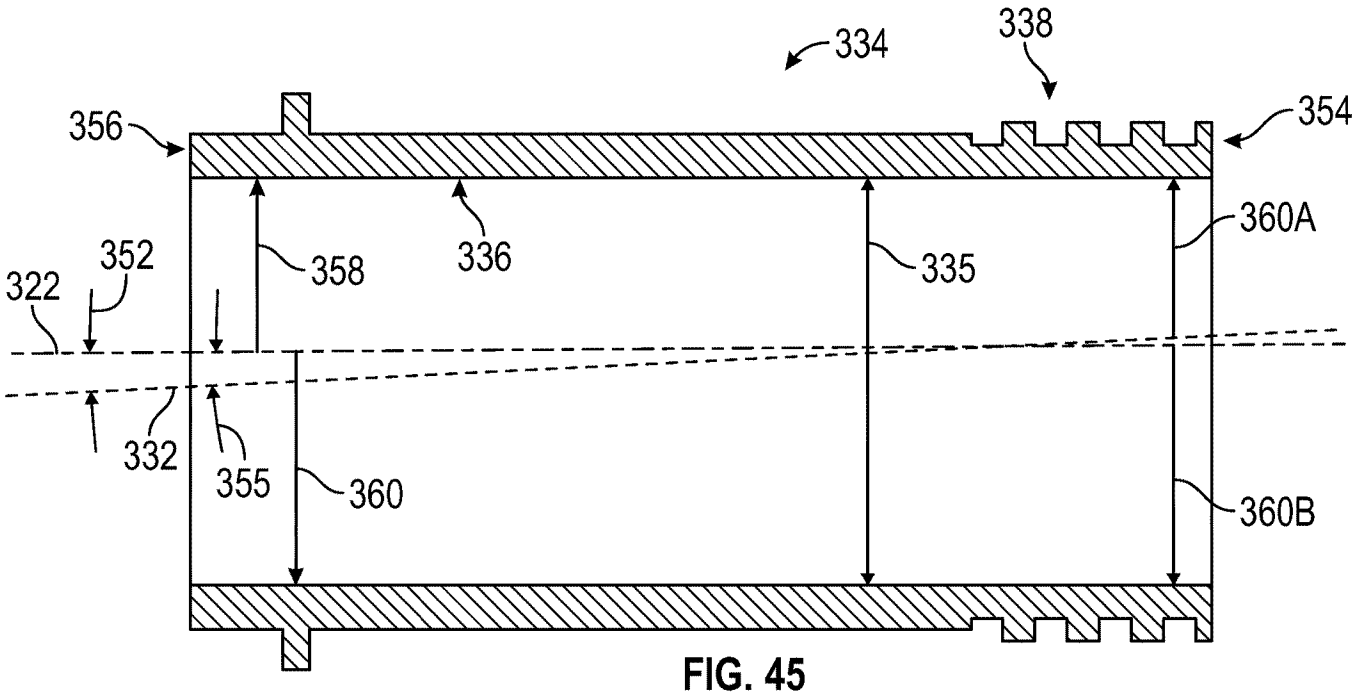
FIG. 45 is a cross-sectional view of an example guide sleeve embodiment.

Referring to FIGS. 44 and 45, the example DCD assembly 320 includes a guide sleeve 334 coupled to an end 340 of the outer barrel assembly 326. In one disclosed embodiment, the guide sleeve includes external threads 338 that are coupled to internal threads 342 of the outer barrel assembly 326. The guide sleeve 334 includes an inner guide surface 336 that is disposed along the guide axis 332. The guide axis 332 is disposed at an angle 352 relative to the central axis 322. The angle 352 is exaggerated in FIGS. 44 and 45 for illustration purposes.

A lower wear sleeve 382 and an upper wear sleeve 384 provide contact points for movement of the assembly 320 through the earth. The wear sleeves 382, 384 are one of three defined contact points for the assembly 320. The drill face is one contact point and the wear sleeves 382, 384 define the other two contact points. The wear sleeves 382, 384 are formed from a steel material that has been hardened to accommodate contact with sides of the bore hole. The wear sleeves 382, 384 protect the outer surface of the barrel assembly 326 against excessive wear during use.

The drive barrel assembly 344 rides along the inner guide surface 336 to change the course of the drill bit 324 as it cuts and forms the borehole. Small changes in the angle that the drill bit 324 forms the borehole is used to steer the DCD assembly 320 and obtain core samples in a desired location. A core barrel assembly 350 for receiving a core sample is disposed within the drive barrel assembly 344 and remains fixed relative the drive barrel assembly 344 and drill bit 324.

Figure 47:
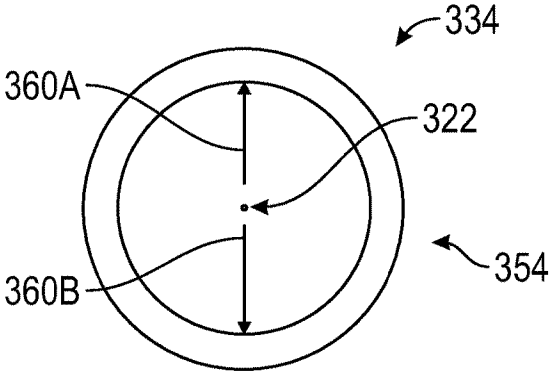
FIG. 47 is rear view of an uphole side of the example guide sleeve.
Figure 46:
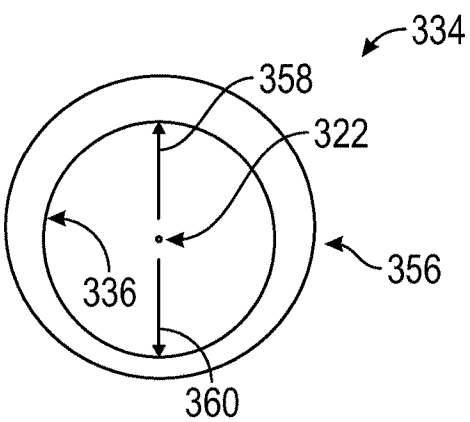
FIG. 46 is a front view of a downhole side of the example guide sleeve embodiment.

Referring to FIGS. 46 and 47 with continued reference to FIGS. 44 and 45, the example guide sleeve 334 includes a fixed inner diameter 335 that is offset a radial distance 355 at a downhole end 356 as compared to an upstream end 354. While the diameter 335 remains constant, it is tilted relative the axis 322. The tilt is offset in a fixed direction to cause a corresponding tilt of the drill bit 324. The guide sleeve 334 remains fixed relative to the rotating drive barrel assembly 344. In one disclosed example embodiment, the bit adaptor 328 rides along the guide surface 336 to define the desired angle of the drill bit 324.

The forward end 356 is shown in FIG. 46 in an exaggerated view to illustrate the radial offset 355. At the forward end 356, the guide surface 336 is spaced a radial distance 358 from the central axis 322 at a top center location. The guide surface 336 is spaced a radial distance 360 from the axis 322 at the bottom center location. At the uphole end 354, shown in FIG. 47, a radial distance 360A and 360B from the top center and bottom center locations are the same. The inner surface 336 is tilted relative to the axis 322 such that diameter remains the same to facilitate guiding of the drive barrel assembly 344.

In one disclosed example embodiment, the angle 352 of the inner guide surface 334 is disposed at an angle of less than about 2° from the borehole central axis 322. In another disclosed embodiment, the inner guide surface 334 is disposed at an angle between ⅛° and ¼° from the borehole central axis 322. In another disclosed embodiment, the angle 352 is between ¾° and ¼° from the borehole central axis 322. Other angles could be utilized and are within the contemplation of this disclosure.

Figure 48:
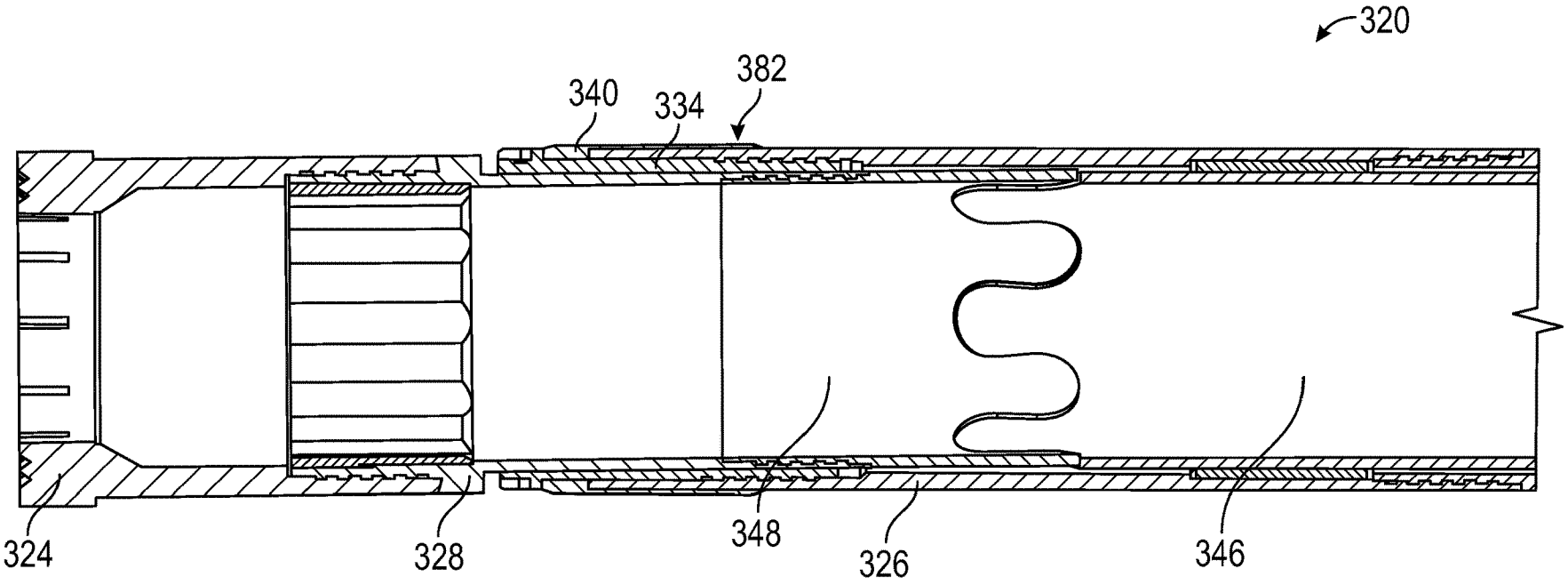
FIG. 48 is a cross-sectional view of a portion of a drive barrel assembly and outer barrel assembly of the direction core drilling assembly of FIG. 43.
Figure 49:
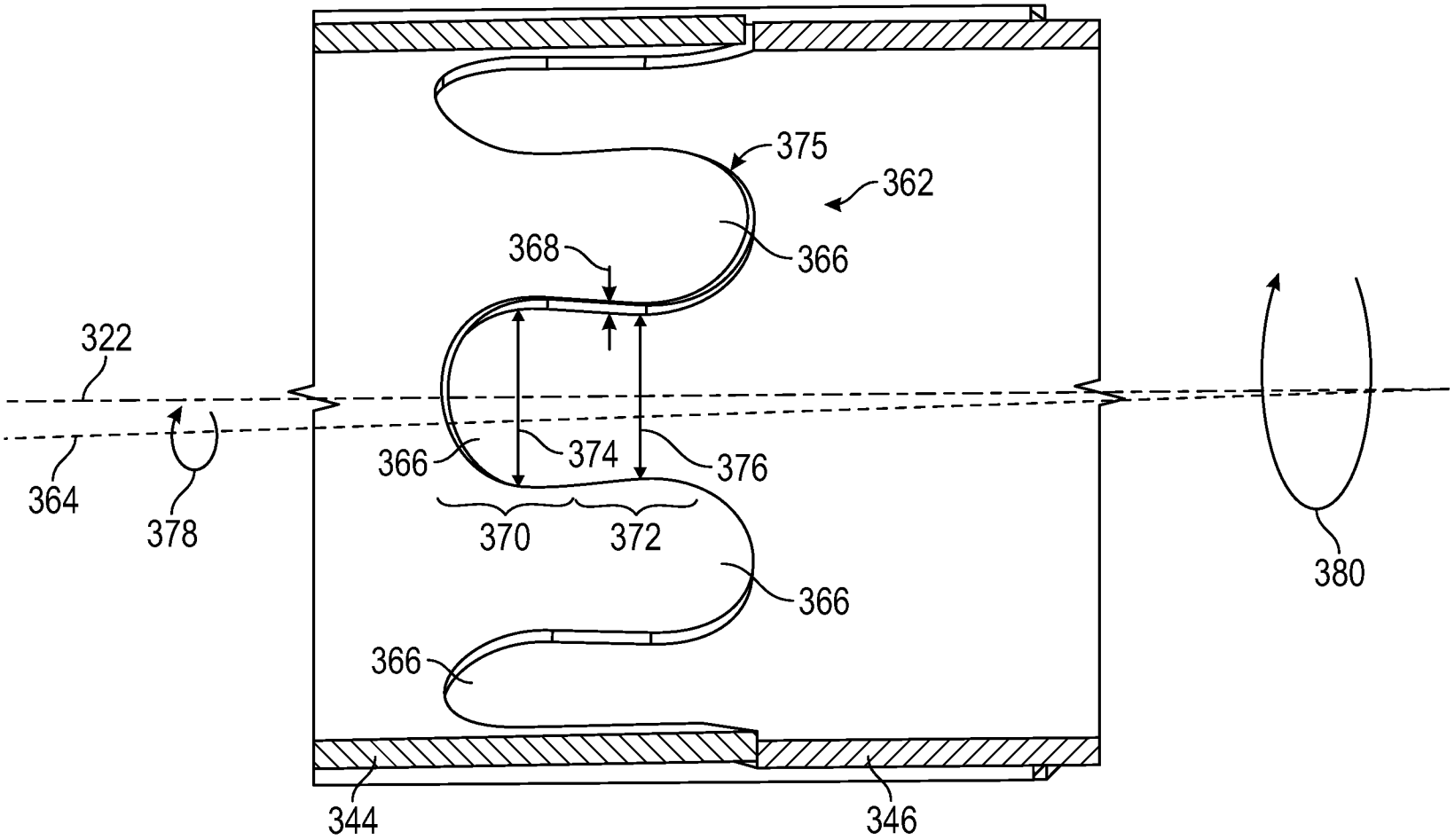
FIG. 49 is an enlarged view of a coupling of the drive barrel assembly.

Referring to FIGS. 48 and 49, the drive barrel assembly 344 includes a main portion 346 that is coupled to a downhole end 348. A coupling 362 between the main portion 346 and the downhole end 348 accommodates the tilt of the drill bit 324 while still driving rotation of the drill bit. The coupling 362 is a continuous gap 375 that extends entirely about the circumference of both the downhole end 348 and the main portion 346. The gap 375 provides for the downhole end 348 to rotate along an axis 364 that is spaced apart from the central axis 322. Accordingly, rotation indicated by arrow 380 about the axis 322 is translated into rotation 378 about the axis 364. The size of the gap 375 provides for the flexibility to accommodate the tilt of the drill bit 324. As the main portion 346 rotates about the axis 322, it drives the downhole end 348 through the coupling 362. The tilt remains in the same clocked position in the direction of the tilt angle 352 (Shown in FIG. 44).

The coupling 362 is formed from captured drive shapes 366 that allow radial movement between the main portion 346 and the downhole end 348, but maintain a driving connection. The example drive shapes 366 hold the axial orientation between the main portion 346 and the downhole end 348 by way of the specific shape. In one example embodiment, the gap 375 define the drive shapes 366 as a plurality of interlocked castellations. Each of the interlocked castellations include a first portion 370 and a second portion 372. The shape is defined such that a width 374 of the first portion 370 is greater than a width 376 of the second portion 372. Because the first portion 370 is larger than the second portion 372, the coupling 362, and thereby the main portion 346 and the downhole end 348 remain locked to each other.

Although the drive shape 366 is shown by way of example, other shapes that provide for transfer of torque through an angled interface could be utilized and are within the contemplation and scope of this disclosure.

In operation, rotation of the main portion 346 of the drive barrel assembly 344 is communicated to the downhole end 348 through driving contact between the drive shapes 366. The gap 375 is sized to accommodate the tilting between the main drive portion 346 and the downhole end. A width 368 of the gap 375 therebetween is sized to enable relative tilting between the downhole end 348 and the main portion 346 that is at least as much as the angle 352 defined by the guide sleeve 334. In one example embodiment, the gap is between 0.025 in and 0.008 in. (0.635 mm and 0.2032 mm). In another example embodiment the gap is between 0.020 in and 0.010 in. (0.508 mm and 0.254 mm). Other gap sizes could be utilized to accommodate other tilt angles.

The direction of the tilt angle of the drill bit 324 is obtained by aligning the tilt relative to a circumferential reference point, such as the axial slot 55 (FIG. 42) that is used to circumferentially locate a downhole orientation device as is commonly used in directional drilling and known by those skilled in the art. For example, the circumferential position of the axial slot 55 is used to orientate the tilt provided by the guide sleeve 334 in order to direct further boring into the earth in a desired direction.

Accordingly, the disclosed DCD assemblies 22, 320 include features for directing a drill bit 30, 324 downhole for obtaining and safely retrieving core samples.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A directional core drilling assembly comprising:

an outer barrel assembly disposed concentrically about a central axis;

a guide sleeve coupled to an end of the outer barrel, the guide sleeve including an inner guide surface disposed along a guide axis that is angled relative to the central axis;

a drill bit configured to form a bore hole;

a drive barrel assembly including a main portion coupled to a downhole portion, the main portion rotationally supported within the outer barrel assembly and the downhole portion is at least partially supported by the guide sleeve, wherein the drill bit is attached to the downhole portion of the drive barrel assembly, and a coupling between the main portion and the downhole portion of the drive barrel assembly comprises a plurality of captured drive shapes formed in each of the downhole portion and the main portion that are configured to transfer torque to the drill bit and accommodate the angle of the inner guide surface of the guide sleeve relative to the central axis;

an inner drive assembly receivable within the outer barrel assembly, the inner drive assembly including a torque latch assembly and an anti-rotation bearing assembly, the torque latch assembly including latch arms configured to releasably couple a rotational drive input to the drive barrel assembly; and a core barrel coupled to the anti-rotation bearing assembly and movable into a position within the drive barrel assembly, wherein the core barrel is rotationally fixed relative to the drive barrel assembly.

2. The directional core drilling assembly as recited in claim 1, wherein the coupling defines a gap between the main portion and the downhole portion that is configured to provide tilting of the downhole portion.

3. The directional core drilling assembly as recited in claim 1, wherein the captured drive shape of the coupling comprises a repeated shape about a periphery of the main portion and the downhole portion.

4. The directional core drilling assembly as recited in claim 1, wherein the captured drive shape between the main portion and the downhole portion comprises identical captured shapes on each of the main portion and the downhole portion.

5. The directional core drilling assembly as recited in claim 1, wherein the guide sleeve includes external threads for coupling to an end of the outer barrel assembly.

6. The directional core drilling assembly as recited in claim 1, wherein the guide sleeve axis is disposed at an angle less than 2° and greater than 0° relative to the central axis of the outer barrel assembly.

7. The directional core drilling assembly as recited in claim 1, wherein the guide sleeve axis is disposed at an angle between ¾° and ¼° relative to the central axis of the outer barrel assembly.

8. The directional core drilling assembly as recited in claim 1, including a bit adaptor attached between the drill bit and the downhole portion of the drive barrel assembly.

9. The directional core drilling assembly as recited in claim 1, wherein the drive barrel assembly includes a drive slot configured to receive a portion of the latch arms such that torque from the inner drive assembly is transferred to the drive barrel assembly through an interface between the latch arms and the drive slot.

10. The directional core drilling assembly as recited in claim 9, wherein each of the latch arms include a downhole facing surface for transferring an axial load to the drive barrel assembly and a rotational drive surface for transferring the rotational input to the drive barrel assembly.

11. The directional core drilling assembly as recited in claim 1, wherein the inner drive assembly includes an anti-rotation shaft and the anti-rotation bearing assembly includes bearings disposed on either side of a center washer that is secured to the anti-rotation shaft.

12. The directional core drilling assembly as recited in claim 1, wherein the core barrel includes a plurality of back angled grooves at an entrance end for holding a core sample within the core barrel.

13. The directional core drilling assembly as recited in claim 1, wherein the drill bit includes an outer drill bit diameter and an inner diameter, wherein the inner diameter is between 58% and 70% of the outer drill bit diameter.

14. The directional core drilling assembly as recited in claim 1, wherein the drill bit includes an outer drill bit diameter and an inner diameter, wherein the inner diameter is between 60% and 68% of the outer drill diameter.

15. The directional drilling assembly as recited in claim 1, including a latch assembly for securing the inner drive assembly within the outer barrel assembly, wherein the outer barrel includes an inner groove and the latch assembly includes first and second lugs that expand radially outward into the inner groove.

16. The directional drilling assembly as recited in claim 15, further including a retrieval assembly with a radially biased key that engages a guide slot defined on an inner surface of the outer barrel assembly for rotationally orientating the retrieval assembly relative to the outer barrel assembly.

17. A directional core drilling assembly comprising:

an outer barrel assembly disposed concentrically about a central axis;

a guide sleeve coupled to an end of the outer barrel, the guide sleeve including an inner guide surface disposed along a guide axis that is angled relative to the central axis;

a drill bit configured to form a bore hole;

a drive barrel assembly including a main portion coupled to a downhole portion, the main portion rotationally supported within the outer barrel assembly and the downhole portion is at least partially supported by the guide sleeve, wherein the drill bit is attached to the downhole portion of the drive barrel assembly;

an inner drive assembly receivable within the outer barrel assembly, the inner drive assembly including a torque latch assembly and an anti-rotation bearing assembly, the torque latch assembly including latch arms configured to releasably couple a rotational drive input to the drive barrel assembly;

a core barrel coupled to the anti-rotation bearing assembly and movable into a position within the drive barrel assembly, wherein the core barrel is rotationally fixed relative to the drive barrel assembly; and a motor generating a rotational torque in response to a fluid flow and a metering ring disposed in the outer barrel proximate the motor defines a fluid passage for exhausting fluid flow from the motor.

18. The directional core drilling assembly as recited in claim 17, including a thrust bearing assembly having a torque shaft, the torque shaft coupled to the motor on one end and to the inner drive assembly on a second end.

19. A directional core drilling assembly comprising:

an outer barrel assembly disposed about a central axis;

a guide sleeve coupled to an end of the outer barrel, the guide sleeve including an inner guide surface disposed along a guide axis that is angled relative to the central axis;

a drill bit;

a drive barrel assembly rotationally supported within the outer barrel assembly, the drive barrel assembly including a downhole portion coupled to a main portion, wherein the downhole portion is movable radially relative to the main portion and the drill bit is attached to the downhole portion of the drive barrel assembly;

an inner drive assembly receivable within the outer barrel assembly, the inner drive assembly including a motor and a torque latch assembly, the torque latch assembly including latch arms configured to releasably couple a rotational drive input to the drive barrel assembly; and a core barrel for receiving and holding a core sample, the core barrel rotationally fixed relative to the drive barrel assembly.

20. The directional core drilling assembly as recited in claim 19, wherein a coupling between the main portion and the downhole portion of the drive barrel assembly comprises a plurality of captured drive shapes formed in each of the downhole end and the main portion configured to transfer torque to the drill bit and accommodate the angle of the inner guide surface of the guide sleeve.

21. The directional core drilling assembly as recited in claim 19, wherein the guide axis is disposed at an angle less than 1° and greater than 0° relative to the central axis of the outer barrel assembly.

22. The directional core drilling assembly as recited in claim 19, wherein the guide axis is disposed at an angle between angle between ¾° and ¼° relative to the central axis of the outer barrel assembly.

23. The directional drilling assembly as recited in claim 19, wherein the drive barrel assembly includes a drive slot configured to receive a portion of the latch arms such that torque from the inner drive assembly is transferred to the drive barrel assembly through an interface between the latch arms and the drive slot.

24. The directional core drilling assembly as recited in claim 23, wherein the inner drive assembly includes an anti-rotation shaft and an anti-rotation bearing assembly including bearings disposed on either side of a center washer that is secured to the anti-rotation shaft.

25. The directional core drilling assembly as recited in claim 24, wherein the drill bit includes an outer drill bit diameter and the drive barrel assembly defines a core diameter, wherein the core diameter is between 58% and 70% of the outer drill bit diameter.

* * * * *